US011725385B2

(12) United States Patent
Mosiadz

(10) Patent No.: US 11,725,385 B2
(45) Date of Patent: Aug. 15, 2023

(54) ACOUSTIC BAFFLE SUSPENSION SYSTEM

(71) Applicant: ROCKWOOL INTERNATIONAL A/S, Hedehusene (DK)

(72) Inventor: Maciej Grzegorz Mosiadz, Hedehusene (DK)

(73) Assignee: ROCKWOOL A/S, Hedehusene (DK)

( * ) Notice: Subject to any disclaimer, the term of this patent is extended or adjusted under 35 U.S.C. 154(b) by 0 days.

(21) Appl. No.: 17/291,020

(22) PCT Filed: Nov. 1, 2019

(86) PCT No.: PCT/IB2019/059388
§ 371 (c)(1),
(2) Date: May 4, 2021

(87) PCT Pub. No.: WO2020/095163
PCT Pub. Date: May 14, 2020

(65) Prior Publication Data

US 2021/0388614 A1 Dec. 16, 2021

(30) Foreign Application Priority Data

Nov. 5, 2018 (EP) ..... 18204412

(51) Int. Cl.
*E04B 9/36* (2006.01)
*E04B 1/86* (2006.01)
(Continued)

(52) U.S. Cl.
CPC ..... *E04B 9/366* (2013.01); *E04B 1/86* (2013.01); *E04B 9/0428* (2013.01); *E04B 9/065* (2013.01);
(Continued)

(58) Field of Classification Search
CPC ..... E04B 9/366; E04B 9/065; E04B 9/0428; E04B 9/225; E04B 1/86; E04B 2001/829;
(Continued)

(56) References Cited

U.S. PATENT DOCUMENTS 3,131,447 A * 5/1964 Tinnerman ..... F16L 3/24 248/300
3,140,071 A * 7/1964 Lorentzen ..... A47H 1/14 248/300
(Continued)

FOREIGN PATENT DOCUMENTS

CA 1086287 A 9/1980
CN 105464272 A 4/2016
(Continued)

OTHER PUBLICATIONS

English translation of the Russian Search Report for Russian Application No. 2021115992, dated Dec. 1, 2021.
(Continued)

*Primary Examiner* — Theodore V Adamos
(74) *Attorney, Agent, or Firm* — Birch, Stewart, Kolasch & Birch, LLP

(57) ABSTRACT

A clip (3) for use in a suspension system for the vertically suspended acoustic baffles (2) and a frame element (4) for the acoustic baffle is provided in a suspended ceiling system. The clip and frame facilitate multiple connection options for a vertically suspended acoustic baffle in a single system.

20 Claims, 22 Drawing Sheets

(51) Int. Cl.

| | |
|---|---|
| ***E04B 9/04*** | (2006.01) |
| ***E04B 9/06*** | (2006.01) |
| ***E04B 9/22*** | (2006.01) |
| ***E04B 1/82*** | (2006.01) |

(52) U.S. Cl.
CPC ..... *E04B 9/225* (2013.01); *E04B 9/068* (2013.01); *E04B 2001/829* (2013.01)

(58) Field of Classification Search
CPC ..... E04B 9/068; F16B 5/121; F16B 5/125; F16B 2/241; F16B 2/243; F16B 5/0642; F16B 5/0635
See application file for complete search history.

(56) References Cited

U.S. PATENT DOCUMENTS

| | | | | | |
|---|---|---|---|---|---|
| 3,536,281 | A * | 10/1970 | Attore | F16L 3/24 | 24/339 |
| 3,589,660 | A * | 6/1971 | Dunckel | F21V 21/02 | 52/39 |
| 3,720,395 | A * | 3/1973 | Schuplin | H02G 3/126 | 220/3.9 |
| 3,774,024 | A | 11/1973 | Deaton | | |
| 4,191,352 | A * | 3/1980 | Schuplin | F21V 21/02 | 52/506.07 |
| 4,266,384 | A * | 5/1981 | Orals | E04B 9/04 | 52/410 |
| 5,653,412 | A * | 8/1997 | Martorano | F21V 21/34 | 362/418 |
| 5,934,019 | A * | 8/1999 | Rotharmel | E05F 15/43 | 49/28 |
| 8,549,810 | B1 * | 10/2013 | Norton | E04B 9/245 | 52/715 |
| 9,279,251 | B2 * | 3/2016 | Bergman | E04B 9/225 | |
| 9,920,525 | B1 | 3/2018 | Underkofler et al. | | |
| 10,174,501 | B1 * | 1/2019 | Underkofler | E04B 9/183 | |
| 11,274,440 | B2 * | 3/2022 | Neubeker | F16B 2/245 | |
| 2012/0291397 | A1 | 11/2012 | Bergman | | |
| 2016/0069076 | A1 | 3/2016 | Holdridge | | |
| 2016/0201323 | A1 * | 7/2016 | Huwer | E04B 9/10 | 403/292 |
| 2019/0161966 | A1 * | 5/2019 | Friez | E04B 9/30 | |

FOREIGN PATENT DOCUMENTS

| | | | | |
|---|---|---|---|---|
| DE | 200 19 236 | U1 | | 5/2001 |
| DE | 10 2015 209 761 | A1 | | 2/2016 |
| EP | 0 816 583 | A1 | | 1/1998 |
| EP | 1 612 340 | A1 | | 1/2006 |
| FR | 1517500 | A | * | 3/1968 |
| FR | 2 386 656 | A1 | | 11/1978 |
| NL | 8500374 | A | | 9/1986 |
| RU | 2 562 308 | C2 | | 9/2015 |
| RU | 2 588 270 | C2 | | 6/2016 |
| WO | WO 93/16246 | A1 | | 8/1993 |
| WO | WO 2017/220103 | A | | 12/2017 |

OTHER PUBLICATIONS

Supplementary European Search Report for corresponding European Application No. 19881790, dated Feb. 21, 2022.
International Search Report, issued in PCT/IB2019/059388, dated Dec. 20, 2019.
Written Opinion of the International Searching Authority, issued in PCT/IB2019/059388, dated Dec. 20, 2019.

* cited by examiner

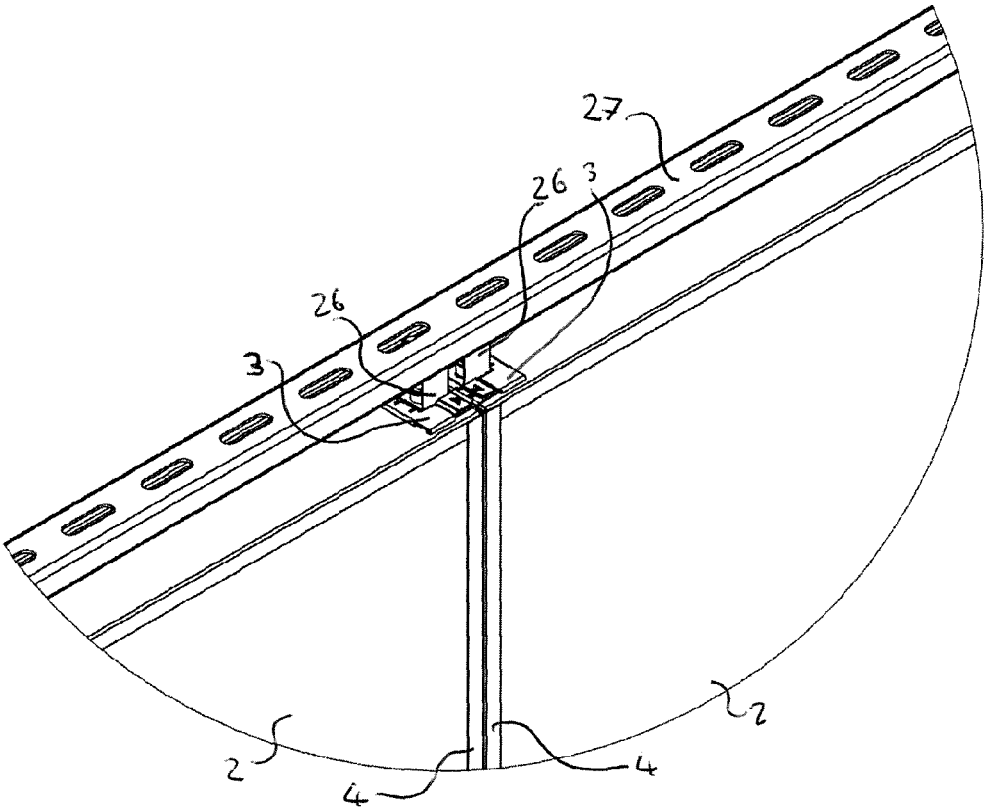
FIG 7B
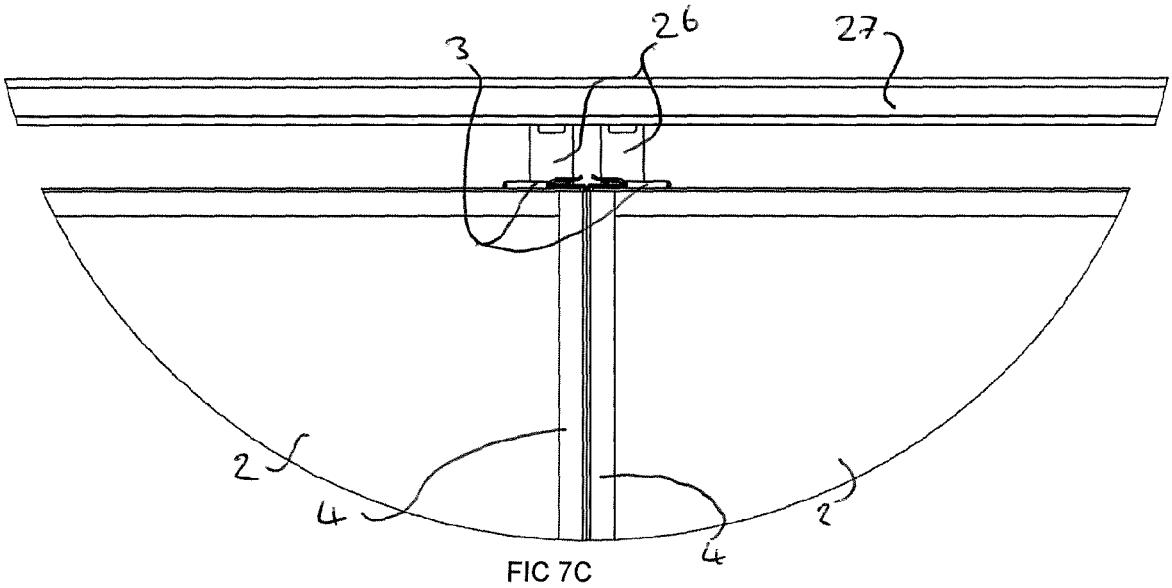
FIC 7C

ACOUSTIC BAFFLE SUSPENSION SYSTEM

FIELD OF THE INVENTION

The invention relates to a system and its component parts for suspension of an acoustic baffle from a ceiling.

BACKGROUND

Acoustic baffles that can be suspended from a ceiling are known in the art. Such baffles can be suspended parallel or perpendicular to the ceiling. The present invention concerns suspension methods for hanging acoustic baffles perpendicular to a ceiling. Examples of existing products are Rockfon® Fibral™ Multiflex Baffle and Rockfon® System Contour Ac Baffle™.

Various methods of suspension exist for attaching acoustic baffles to a ceiling.

NL8500374 shows a hook-type suspension arrangement. This requires a particular profile within the acoustic baffle itself, requiring additional processing steps in order to make the necessary profile within the baffle.

WO2017/220103A1 shows a suspension arrangement in which the uppermost edge of an acoustic baffle is provided with an inverted T-shaped slit that extends through the entire baffle, running between the two major faces of the baffle. A separate component must be inserted into this slit in order to enable installation of the baffle on a ceiling by e.g. a suspension wire which must connect to the separate component. Depending on the desired suspension method, a multitude of different components will be required. Furthermore, the construction of the acoustic baffle itself is somewhat complex, with a folding arrangement.

DE102015209761A1 describes a complex arrangement of a number of components necessary to suspend a single acoustic baffle. The suspension means involves suspension cables, cable clamps and other components. Using so many components increases production and installation costs.

EP1612340A1 describes a baffle system for a suspended ceiling in which mounting on non-horizontal beams and mounting a plurality of baffles at different angles to each other is facilitated by a multi-component fastening device. This baffle system is somewhat complex, requiring multiple components, which increases the cost of manufacture and installation of acoustic baffles.

EP0816583A1 describes a mounting system for vertical installation of an acoustic baffle, in which a plurality of films is mounted in a bracket clamp arrangement (FIG. 1). Suspension from a ceiling is achieved by wire ropes or similar, connected to the bracket clamps. This setup is specific to acoustic baffles that comprise a plurality of films or foils and has a cumbersome attachment arrangement to secure the lower bracket to the upper bracket. Furthermore, it is not possible to connect the baffle to a grid.

WO93/16246 describes a system for vertical suspension of acoustic baffles. The system involves a clamp that is integral with the frame for the baffle. This system facilitates connection only to grid beams having an inverted-T profile or an I-beam profile.

U.S. Pat. No. 9,920,525 B1 discloses an acoustical baffle assembly in which an upper edge of an acoustical panel is clinched in a plurality of clips, for vertical suspension at any point along the length of a header bar.

DE 200 19 236 U1 discloses a system for horizontal suspension of metal ceiling panels, in which the metal panels are clipped into a system of ceiling runners.

US 2016/069076 A1 a ceiling system for horizontally mounting ceiling panels to a ceiling grid, the mounting means including a spring clip.

SUMMARY

The invention provides a system for vertical suspension of an acoustic baffle as defined in claim 1. With this system it is possible to vertically suspend an acoustic baffle by a variety of suspension means with a single neat and easily-installed product. For example, suspension wires could be used, attached via anchors in the acoustic baffle, screws in the frame, or a mechanism such as a hook, karabiner, loop or other such attachment means.

Previous suspension systems have involved multiple and often complex suspension means. The attachment methods were sometimes restricted by the type of fastening means provided with the acoustic baffle. Some systems even utilised multiple attachment devices for a single ceiling. With the invention, multiple attachment means are possible with a single system. This reduces costs and complexity by reducing the number of components required to achieve a range of acoustic ceilings setups.

The invention further provides a suspended ceiling as defined in claim 9. A suspended ceiling in accordance with the invention may be faster, cheaper and easier to install compared to previous suspended ceilings, due to that fact that a variety of suspension mechanisms can be used with the same frame and clip of the invention. This brings versatility to the design of an acoustic ceiling without the need for making and stocking many different components.

The invention also provides a clip as defined in claim 19 for use in a suspension system for vertical acoustic baffles. The clip works together with the frame element of the invention to provide an elegant means for vertical suspension of an acoustic baffle by various suspension devices.

The invention also provides a frame element as defined in claim 21 for use in a suspension system for vertical acoustic baffles. The frame element works together with the clip of the invention to provide an elegant means for vertical suspension of an acoustic baffle by various suspension devices.

System

The system of the invention is a system for vertical suspension of an acoustic baffle, the system comprising a) a frame element;

b) a clip configured for connection to the frame element, wherein the clip comprises a body plate, one or more fastening elements for securing the clip to the frame element, and a first aperture;

c) a foldable tab comprising a second aperture.

The first aperture is located in the clip. If the frame element overlaps with the first aperture when the clip and the frame element are connected, the frame element suitably comprises a larger aperture to align with the first aperture in the clip. Likewise, if the frame comprises an upper profile, which is optional, a larger aperture than the first aperture is provided such that it aligns with the first aperture of the clip wen the frame and clip are connected and installed.

The first aperture may be smooth or threaded. A threaded first aperture may be preferable to enable wire suspension using screw-type anchors. However, other types of anchor for suspension wires may be used in conjunction with the first aperture. The first aperture provides connection means for suspension rods or wires.

Preferably, the first aperture has the form of a single thread-engaging nut that is pressed into the body plate of the clip. This type of aperture facilitates connection to threaded suspension means such as bolts and threaded rods, whilst affording the possibility for corrosion protection by means of, for example, galvanisation, powder coating and the like.

The foldable tab may suitably be positioned as part of the frame element and is foldable such that, in its unfolded state, it stands substantially vertically when the system is oriented in its installed state, i.e. approximately normal to an upper minor face of an acoustic baffle. The foldable tab comprises a second aperture, which facilitates connection to suspension wires via a mechanical connector such as a hook. The shape of the clip may be adapted to provide a space for folding the foldable tab.

The foldable tab is preferably located at the corner of the frame element, to provide for a stable suspension position when using suspension wires and to reduce the risk of deformation of the frame element when loaded with the weight of an acoustic baffle.

The clip may comprise one or more substantially planar legs joined to the body plate by an upwardly-angled joint such that the one or more substantially planar legs are parallel to the body plate. Suspension by direct attachment to a grid is also possible in a single neat solution when the legs are present. In this context, "upwardly-angled" refers to the positioning of the leg and joint relative to the body plate when the clip is positioned as it would be in the installed state, with the body plate substantially flat located on the top of the uppermost minor face of an acoustical baffle that is vertically suspended.

When the suspension method is direct connection to a grid of inverted T-profile beams, the clip and the frame element work together to provide a slot into which the flange of an inverted T-profile fits. The one or more legs of the clip each comprise a gripper for secure connection to an inverted T-profile. The gripper may comprise an embossment protruding in the direction of the frame element, i.e. into the space in which an inverted T-profile fits. Using an embossment means that the gripper can be formed from the same single piece of material as the rest of the clip, for example from a single sheet of metal.

To facilitate easy connection directly to an inverted T-profile beam, the one or more legs of the clip may terminate in an upwardly-angled flange.

The clip and the frame element may be joined together by the installer of an acoustic ceiling, or may be provided ready-installed, i.e. the clip and frame element may be assembled at the factory. The clip and the frame element are configured for connection.

Connection may be facilitated by forming the body plate into an upper plate and a lower plate joined by and rotatable about a fold, such that the clip can be pressed onto the flap of the frame element. This manner of connection may be particularly suited to factory assembly, thereby decreasing the on-site installation time for a vertically-suspended acoustic ceiling.

Connection may be facilitated by sliding connection. In this case, the body plate of the clip may be provided with wings that fold underneath the body plate and slide along the flap may be especially suitable if the frame element is a side profile comprising a flap that is foldable around an angle of 90° to the upper minor face of a suspended acoustic baffle, such that and elongate portion of the frame element supports a side minor face of an acoustic baffle and the end portion folds to an upper minor face of an acoustic baffle and facilitates sliding connection with the clip.

The clip and the frame element are secured together by one or more fastening elements. These fastening elements may be releasable, to facilitate easy maintenance of the acoustic ceiling. Alternatively the fastening elements may provide a permanent connection between the clip and the frame element.

The fastening element may comprise a resilient catch. This may click into place when the clip and frame element are connected and can be released for maintenance. The resilient catch can be formed from the same single sheet of metal or other material as the remainder of the clip, thereby making the production process more efficient. A resilient catch can connect with a hole or indentation in the underlying frame element when the two components are assembled. In this case, the clip and the frame element are configured such that the hole or indentation in the frame element aligns with the resilient catch of the clip.

The fastening may comprise a tongue and slot arrangement. The tongue may be formed from the same sheet as the rest of the clip and may be configured to align with a slot in the frame element. This fastening mechanism can be secured and released by the installer.

The clip is preferably made from a thicker and stronger material than the frame element. In this manner, the total amount of material can be reduced, because the frame element can be made from a single sheet of material, preferably metal, with the strength necessary for certain suspension means being provided by the clip.

Preferably the clip is formed from a sheet of steel of thickness 0.9 mm. Preferably the frame element is formed from a sheet of steel of thickness 0.6 mm.

Clip

The clip comprises a body plate, one or more fastening elements for securing the clip to a frame element, and a first aperture. The clip may also comprise any of the optional features discussed above.

The clip may optionally comprise one or more legs as described above. The legs of the clip are upwardly angled from the body of the clip so as to provide a space for connection directly to an inverted T-profile beam. The grippers on the one or more legs help to secure such a direct connection against movement.

The clip may be provided with wings on opposing edges of the body plate. Each wing is preferably connected to the body plate by a U-shaped fold such that the wing lies underneath the body plate. In this manner, the wings facilitate sliding connection to a frame element. Wings may be present whether providing the main connection means by sliding, or whether in support of a folding connection means for the clip and the frame element.

The clip is provided with one or more fastening elements to secure it to a frame element for use in a suspension system. Preferably such fastening elements are releasable to facilitate maintenance of an acoustic ceiling that uses the clip. However, some applications may be more suited to a permanent connection means, which is also possible in the invention.

The fastening elements of the clip may comprise a resilient catch type of mechanism, which may click into place when the clip is connected to a frame element. Alternatively, a tongue and slot type of arrangement may be provided, with the tongue part formed from the body plate of the clip. Other fastening elements are possible within the invention.

The body plate of the clip may be folded so as to provide a lower part and an upper part connected by a U-shaped fold. Having an upper and lower part of the body plate may provide an overall stronger clip and increases the versatility of connection means for suspending an acoustic baffle. This folded arrangement is preferable when a tongue and slot fastening arrangement is provided. Wings may optionally be provided in this implementation of the invention, for example to stabilise alignment of the upper part of the body plate with the flap of the frame element prior to bringing the lower part of the body plate to the flap of the frame element, thereby closing the clip together.

When the clip is connected to a frame element, the upper and lower parts of the body plate may sit on opposing faces of the end portion of the frame element, thereby providing an especially secure connection between the clip and the frame element.

Frame Element

The frame element may be a side profile or an upper profile of the frame that supports an acoustic baffle for vertical suspension. In either case, an end portion provides attachment means for a clip for use together in the suspension system of the invention.

A side profile is preferred for the frame element. The upper profile of the frame is often not visible in the installed state of a vertical acoustic suspended ceiling and therefore may be omitted to save costs and materials.

The frame element is preferably glued to a minor face of an acoustic baffle.

Optionally, the frame element as a side profile may be provided with locking means, thereby facilitating neat alignment when a plurality of acoustic baffles are to be vertically suspended adjacent at minor vertical faces.

The frame element may provide a first aperture, which may be threaded. The first aperture allows suspension of an acoustic baffle via anchored suspension wires. The anchor may be a screw-type device, for which the aperture is preferably threaded. Alternatively, the anchor may be secured by other means within the acoustic baffle itself, for example by embedded arms.

The first aperture may be provided solely in the frame element. However, the clip may also provide an equivalent first aperture. In this case, the frame element, if underlying the first aperture of the clip when installed, is provided with an aperture larger than the first aperture of the clip so as not to interfere with connection of the first aperture to a suspension means. Where the frame element is a side profile, the optional upper profile may also provide a large aperture in a similar manner that does not interfere with the first aperture when overlapping when installed.

The end portion of the frame element preferably comprises a foldable tab that comprises a second aperture. This tab may be flush, or at least substantially parallel, with the upper profile of the frame or acoustic baffle when the suspension method does not require a loop. In this manner, the tab does not interfere with the other suspension mechanisms afforded by the system.

The tab may be foldable by the installer by hand or by using hand tools. When the required suspension method requires use of suspension wires in combination with a hook, karabiner or the like, the tab may be folded upwards such that it is substantially parallel with the side profile of the frame. In this manner, a loop is provided by the second aperture in the tab, to which a suspension wire or rod may be attached by any suitable attachment means.

Frame

A frame may be provided for support of an acoustic baffle in vertical suspension. Where the baffle is rectangular, the frame preferably provides two side profiles. A lower profile is aesthetically desirable, but is not essential for suspension of an acoustic baffle. An upper profile is optional, because it is typically not visible to a person standing below a vertical suspended acoustic baffle and therefore materials and cost savings can be made by omitting the upper profile from the frame. Nevertheless, a lower profile, an upper profile, or both can be provided as part of the frame.

The frame element of the suspension system is preferably a side profile, but may alternatively be the upper profile.

Each profile of the frame is typically configured to cover a minor face of an acoustic baffle, with small wings folding round to each of the two major faces of an acoustic baffle. This arrangement supports an acoustic baffle adequately for vertical suspension from a ceiling.

Suspended Ceiling

The suspension system, clip and frame elements of the invention are suitable for use as part of a suspended ceiling. Such ceiling may be configured in various ways, due to the versatility of the suspension system of the invention. In the suspended ceiling of the invention, acoustical baffles are suspended in a substantially vertical orientation.

Suspension wires may be provided from a soffit or from beams, from which an acoustic baffle can be suspended using the system of the invention in several ways: hooks, clips, karabiners, screws, anchors and other means may be used successfully with the suspension system of the invention. In particular, the first aperture and second aperture enable a wide variety of connection mechanisms for hooks, wires, rods, and other anchoring means. With the invention, in effect a single suspension wire or rod can be used per acoustic baffle when a wall of acoustic baffles is vertically suspended, because two adjacent acoustic baffles can connect at adjacent minor faces to the same wire or rod by using the suspension system of the invention.

A grid of beams having an inverted T-profile may be provided, to which the suspension system can directly grip onto in the case where the clip is provided with legs.

The installer thereby has the flexibility to use the most appropriate suspension system for each interior space, without needing to stock multiple frame components and multiple connector components. Furthermore, several connection means can be used in the same interior space to achieve a varied shape and appearance of acoustic ceiling.

Acoustic Baffle

Any type of acoustic baffle may be used with the present invention. Exemplary types of acoustic baffle are those made from bonded man-made vitreous fibres (MMVF) such as stone wool, glass wool or slag wool, those made from wood wool, those made from foams, and other types of acoustic baffles. MMVF acoustic baffles are preferred.

Preferably the acoustic baffle is substantially rectangular. A rectangular-shaped acoustic baffle may facilitate a simpler frame construction than other shapes.

The acoustic baffle is suitably suspended in a substantially vertical arrangement from a ceiling. A plurality of such acoustic baffles, suspended in a vertical manner in an array, can provide excellent acoustic conditions in an interior space. This can improve the working environment in places such as schools and offices.

BRIEF DESCRIPTION OF DRAWINGS

FIG. 7B shows two adjacent baffles suspended by the means shown in FIG. 7A;

FIG. 7C is a side view of the arrangement in FIG. 7C;

DETAILED DESCRIPTION

An embodiment of the invention can be seen in FIGS. 1 to 3D. An exploded view of a suspension system 1 and an acoustic baffle 2 can be seen. The acoustic baffle comprises an upper minor face 2*a*, a lower minor face 2*b*, two side minor faces 2*c* and two major faces 2*d*.

Figure 1:
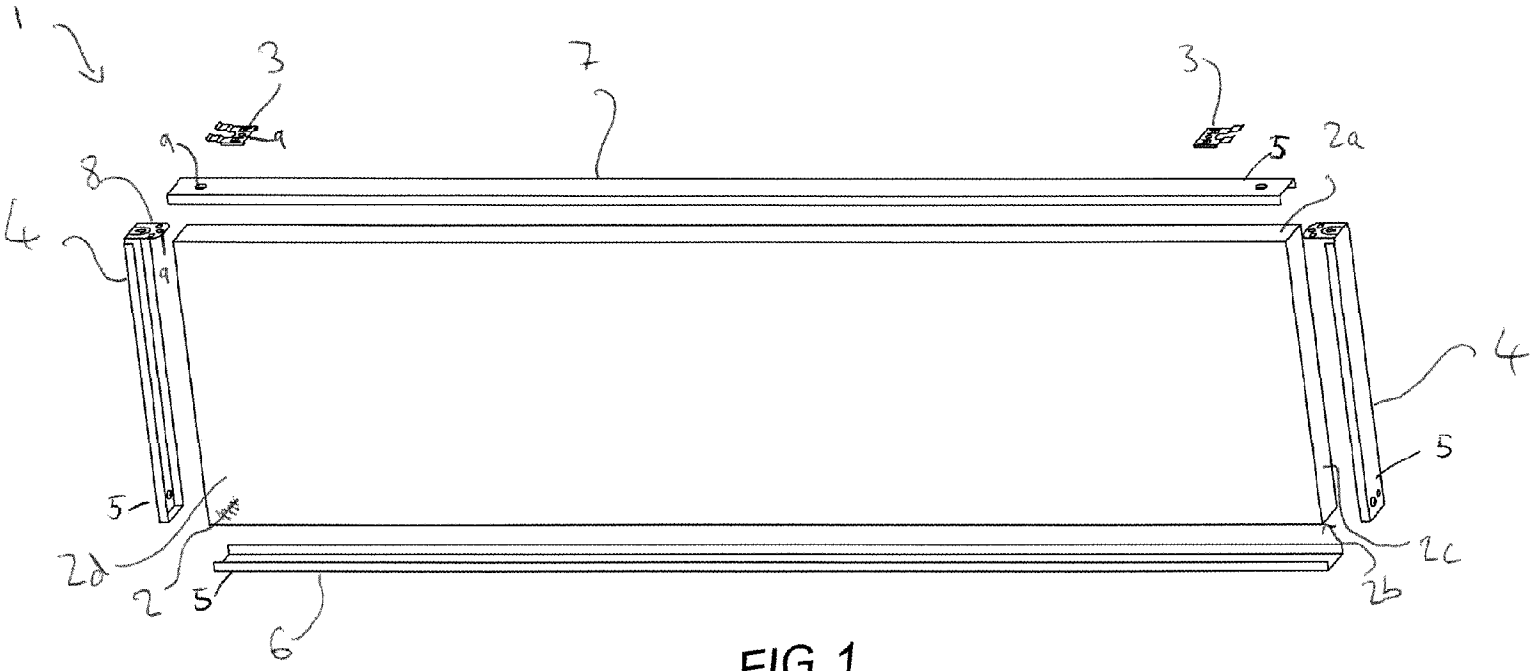
FIG. 1 is an exploded view of an acoustic baffle and vertical suspension system.

The suspension system 1 comprises clips 3 and frame elements 4. In FIG. 1, the frame elements 4 form the side profiles of the frame 5 for the acoustic baffle 2.

In this embodiment, the frame 5 further comprises a lower profile 6 and an upper profile 7. The upper profile 7 is not essential for the suspension system 1 if the side profile is the frame element 4. This is because the upper profile 7 will not normally be visible when the acoustic baffle is installed and so a material and cost saving can be made if the upper profile 7 is omitted.

The frame elements 4 each comprise a flap 8 that is shown folded around 90° towards the upper profile 7 of the acoustic baffle 2. Details of the frame elements 4 are shown in FIGS. 2A to 2D.

The upper profile 7 in FIG. 1 comprises a first aperture 9. The first aperture 9 can be positioned in several locations. In the embodiment illustrated by FIG. 1, the first aperture 9 (i.e. a press nut) is present in the upper profile 7, the frame element 4 and the clip 3. When assembled, the clip 3, frame element 4 and upper profile 7 align such that there is a single threaded first aperture 9 passing through all three components in alignment.

Figure 2A:
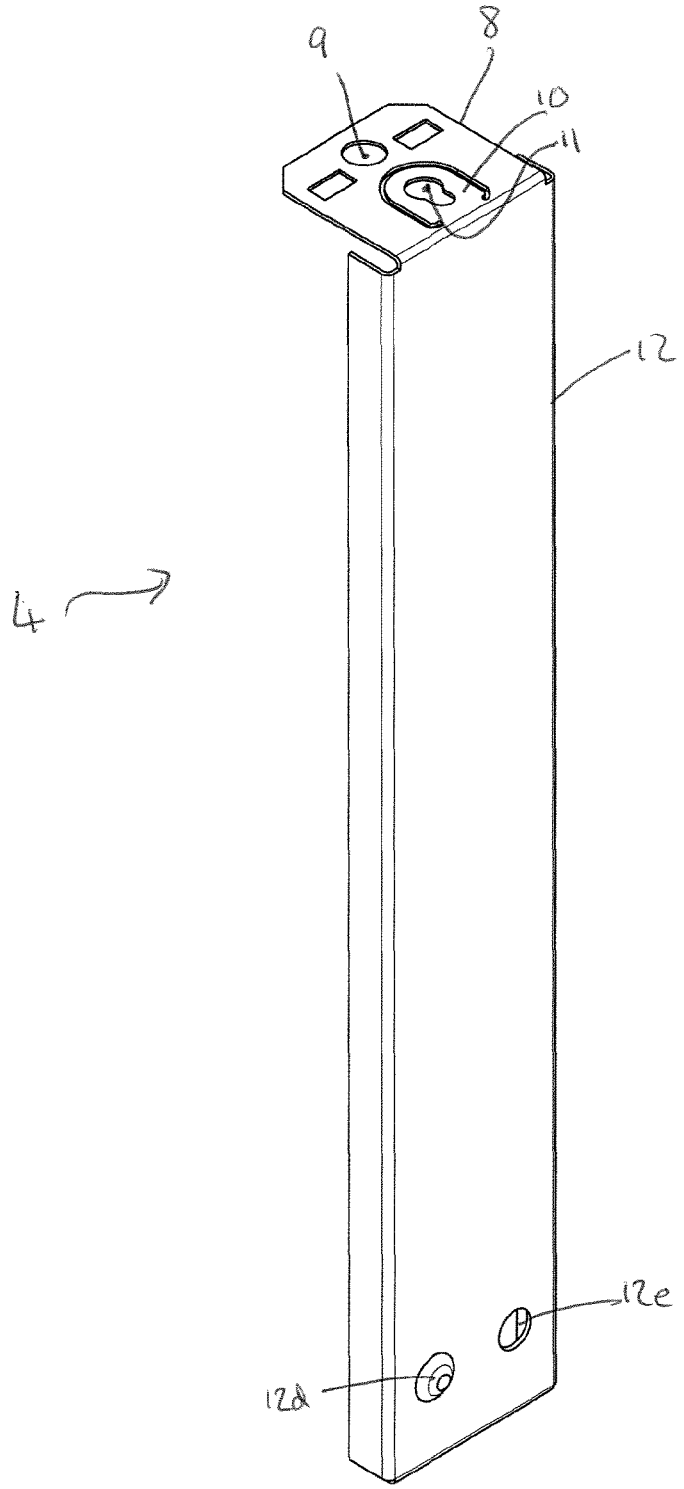
FIG. 2A is a perspective view of a side profile frame element from FIG. 1.

FIG. 2A shows the frame element 4 in a detailed profile view. The flap 8 comprises a foldable tab 10, the tab 10 comprising a second aperture 11. The tab 10 may be folded through 90° towards the upper profile of an acoustic baffle with the remainder of the tab 10 when the second aperture 11 is not required for suspension of an acoustic baffle. In this folded state as shown in FIG. 2A, the tab 10 does not interfere with the other suspension mechanisms of the suspension system 1. Alternatively (not shown), the tab 10 may be folded back from the remainder of the flap 8 through approximately 90° to be continuous with the elongate portion 12. This arrangement allows for suspension of an acoustic baffle by means of suspension wires and hooks, karabiners or similar means in conjunction with the second aperture 11 formed in the tab 10.

Figure 2B:
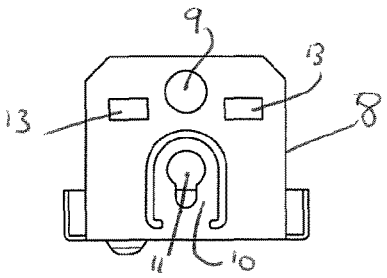
FIG. 2B is a top view of the same side profile frame element, in a folded state.

FIG. 2B shows a plan view of the flap 8 of the frame element 4. The tab 10 is shown folded down with the remainder of the flap 8. The second aperture 11 formed in the tab 10 is shown. This view also illustrates the threaded first aperture 9 formed in the flap 8. When the suspension system is assembled, the threaded first aperture 9 goes through the flap 8, the upper profile 7 and the clip 3 as a single aligned aperture. Two holes 13 formed in the flap 8 align with the fastening elements (shown in FIG. 3A) of the clip 3 when the suspension system 1 is assembled. FIG. 2B shows these as holes 13, but indentations (not shown) may be used as an alternative to the holes 13 to achieve secure connection with the clip 3.

Figure 2C:
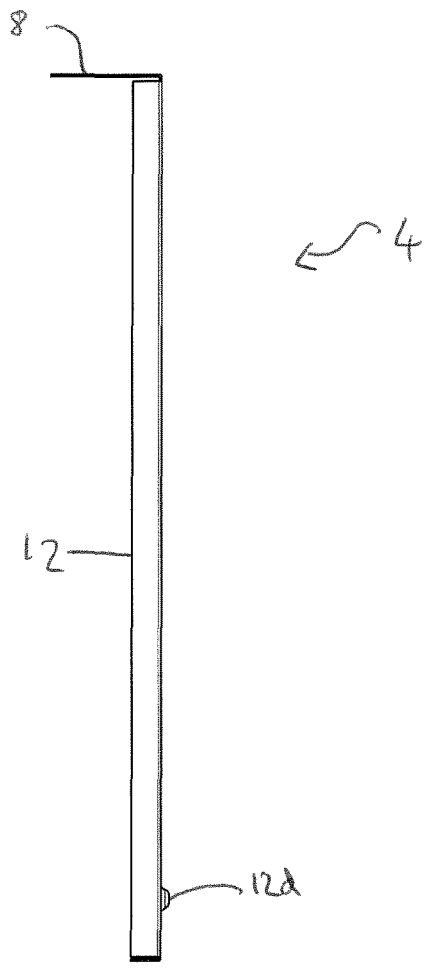
FIG. 2C is a side view of the same side profile frame element.

FIG. 2C shows in a side view how the flap 8 is folded through 90° from the elongate portion 12 of the frame element 4 when the suspension system is assembled.

Figure 2D:
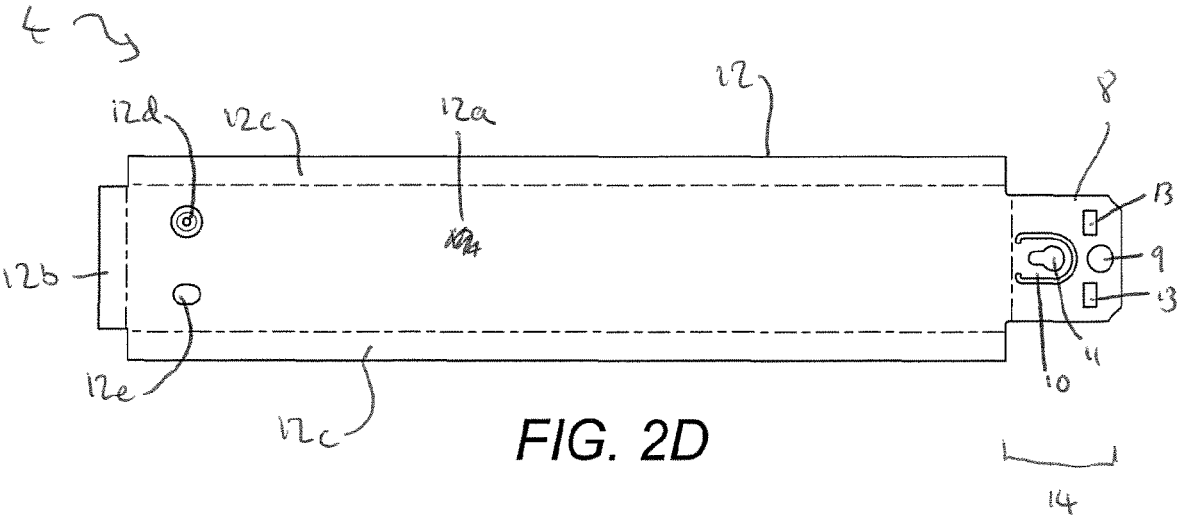
FIG. 2D is a plan view of the same side profile frame element, shown flat.

FIG. 2D shows a layout view of the whole frame element 4 in its implementation here as a side profile of the frame 5. This view demonstrates how the frame element 4 can initially be formed from a single sheet of metal or other material and subsequently folded by machine or by hand to form the finished frame element 4. The elongate portion 12 comprises a main plate 12*a*, a base wing 12*b* that folds towards the lower minor face of an acoustic panel and two side wings 12*c* that fold toward each of the two major faces of an acoustic panel. The end portion 14 comprises a flap 8, in which the foldable tab 10, second aperture 11, threaded first aperture 9 and holes 13 can be seen. The tab 10 can be folded by a person using regular hand tools. The elongate portion 12 of the frame element 4 may optionally comprise locking elements 12*d* and 12*e*, which help to secure adjacent baffles to one another, thereby facilitating the possibility of neatly aligning an array of vertically-suspended acoustic baffles.

Figure 2E:
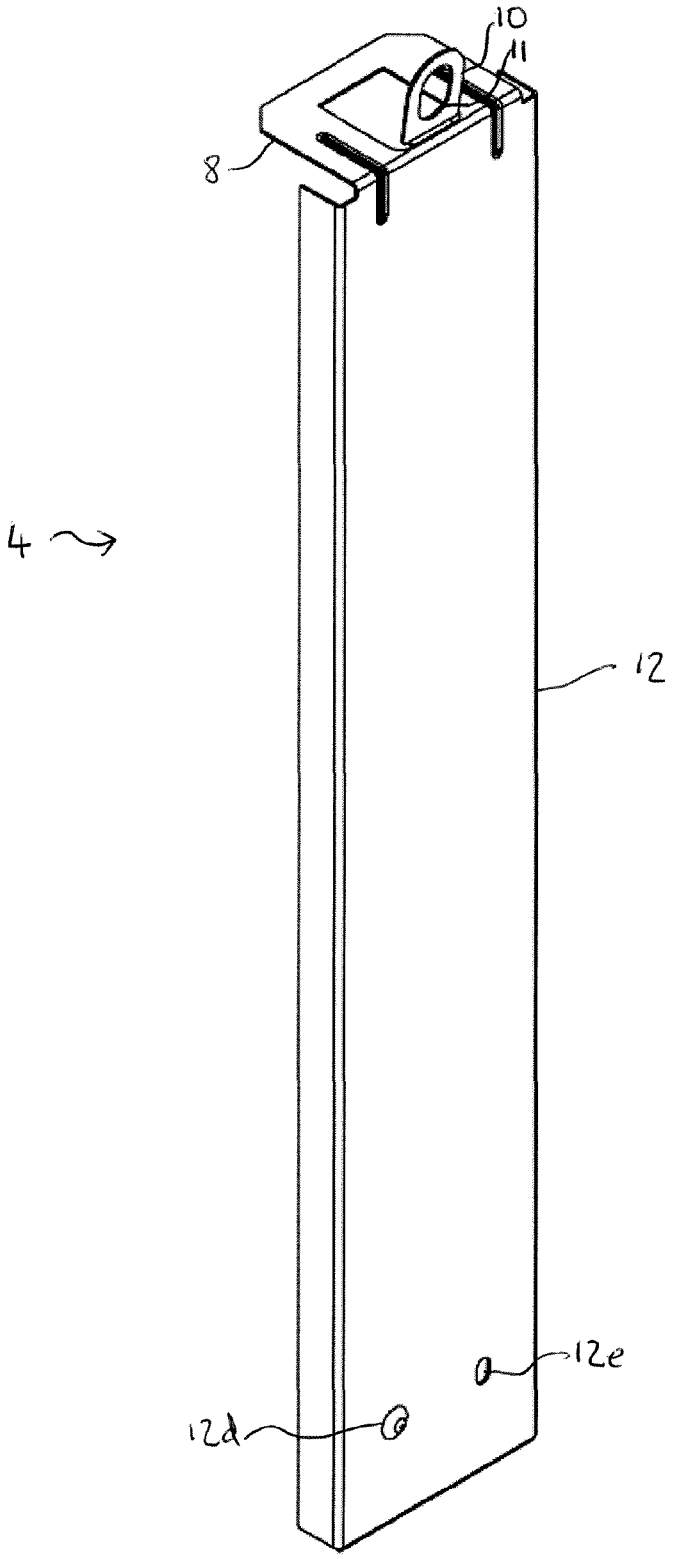
FIG. 2E is a view of the frame element.

FIG. 2E shows the tab 10 in an open position, which would be pointing upwards in the installed state.

Figure 3A:
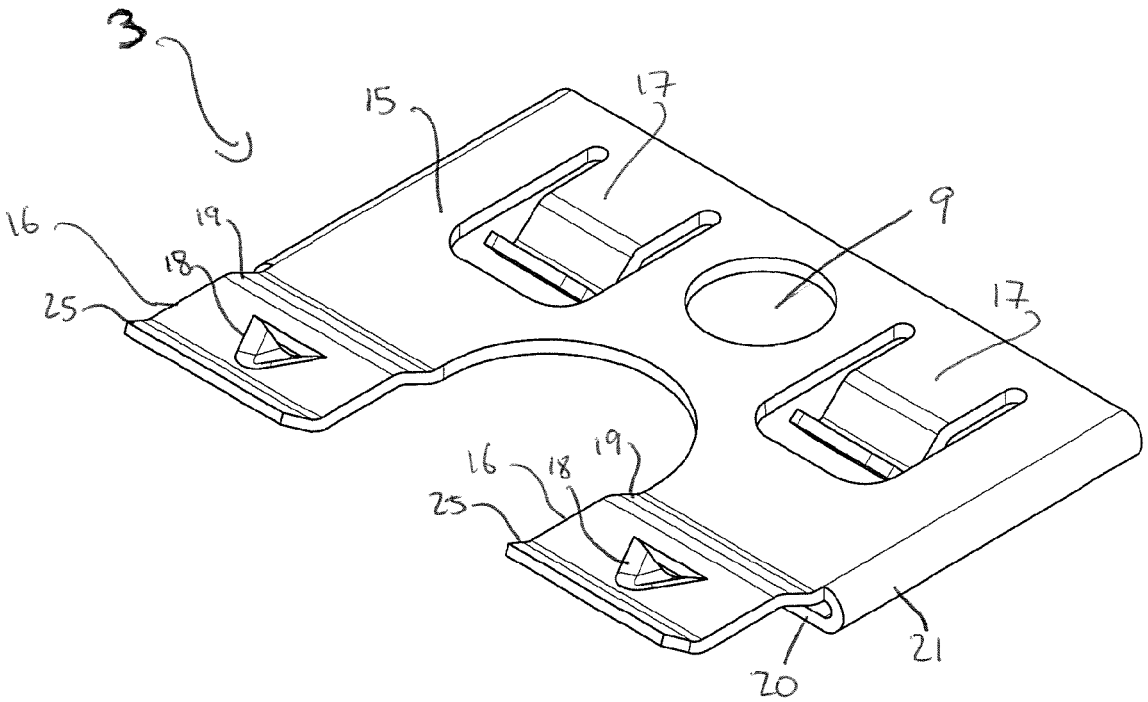
FIG. 3A is a perspective view of a clip from FIG. 1.

FIG. 3A shows a perspective view of the clip 3. The clip 3 comprises a body plate 15, a first aperture 9, two legs 16 and two fastening elements 17. In this embodiment, the fastening elements 17 are resilient catches, in this example of the sprung click-and-lock type means of securing the clip 3 to the underlying frame element 4. This mechanism is releasable to allow routine maintenance of a suspended acoustic baffle and suspension system. The fastening elements 17 shown here interlock with the holes 13 in the underlying frame element 4 when the suspension system 1 is assembled.

Each leg 16 in FIG. 3A is provided with a gripper 18. In this instance, the gripper is formed by an embossment which is convex in the direction facing an underlying frame element 4 (not shown in FIG. 3A). Each leg 16 is substantially planar and is connected to the body plate 15 by means of an upwardly-angled joint 19. This positions the main part of each leg in an elevated manner relative to the body plate 15, but still substantially parallel to the body plate 15. The space between the legs 16 and the end portion of the frame element 4 when connected together provides a slot into which a flange of a suspension beam (not shown) can fit. The gripper 18 on each leg assists in holding the assembled suspension system to the beam, thereby securing an acoustic baffle in a vertical manner to form an acoustic ceiling.

Each leg 16 further comprises an upturned flange 25 at the end distal to the body plate 15 of the clip 3. The flange 25 aids easy installation of the suspension system to a beam (not shown).

The clip 3 also comprises a wing 20 on each of two opposing sides of the body plate 15 and connected to the body plate 15 by means of a U-shaped fold 21.

Figure 3B:
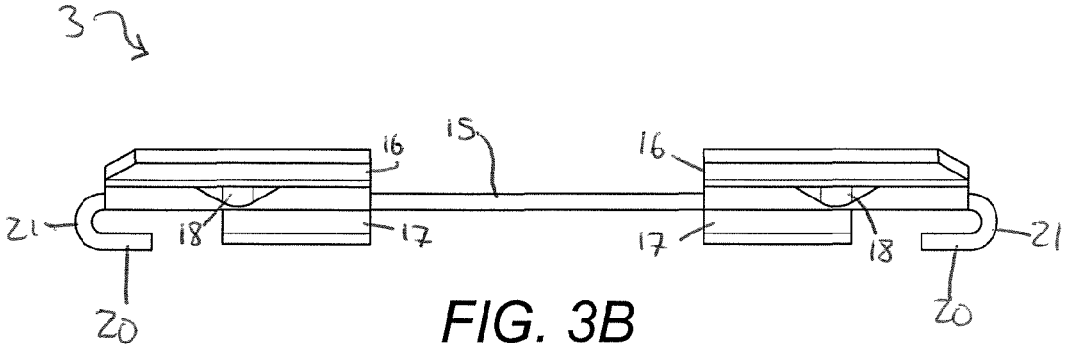
FIG. 3B is a side view of the same clip.

The wings 20 can be seen in more detail in FIG. 3B, which is a view in the plane of the body plate 15. The wings 20 fold underneath the body plate 15 so as to provide sliding connection means for connecting the clip 3 to a frame element 4 (not shown). FIG. 3B also shows how the legs 16 are positioned in a plane elevated from the plane of the body plate 15.

Figure 3C:
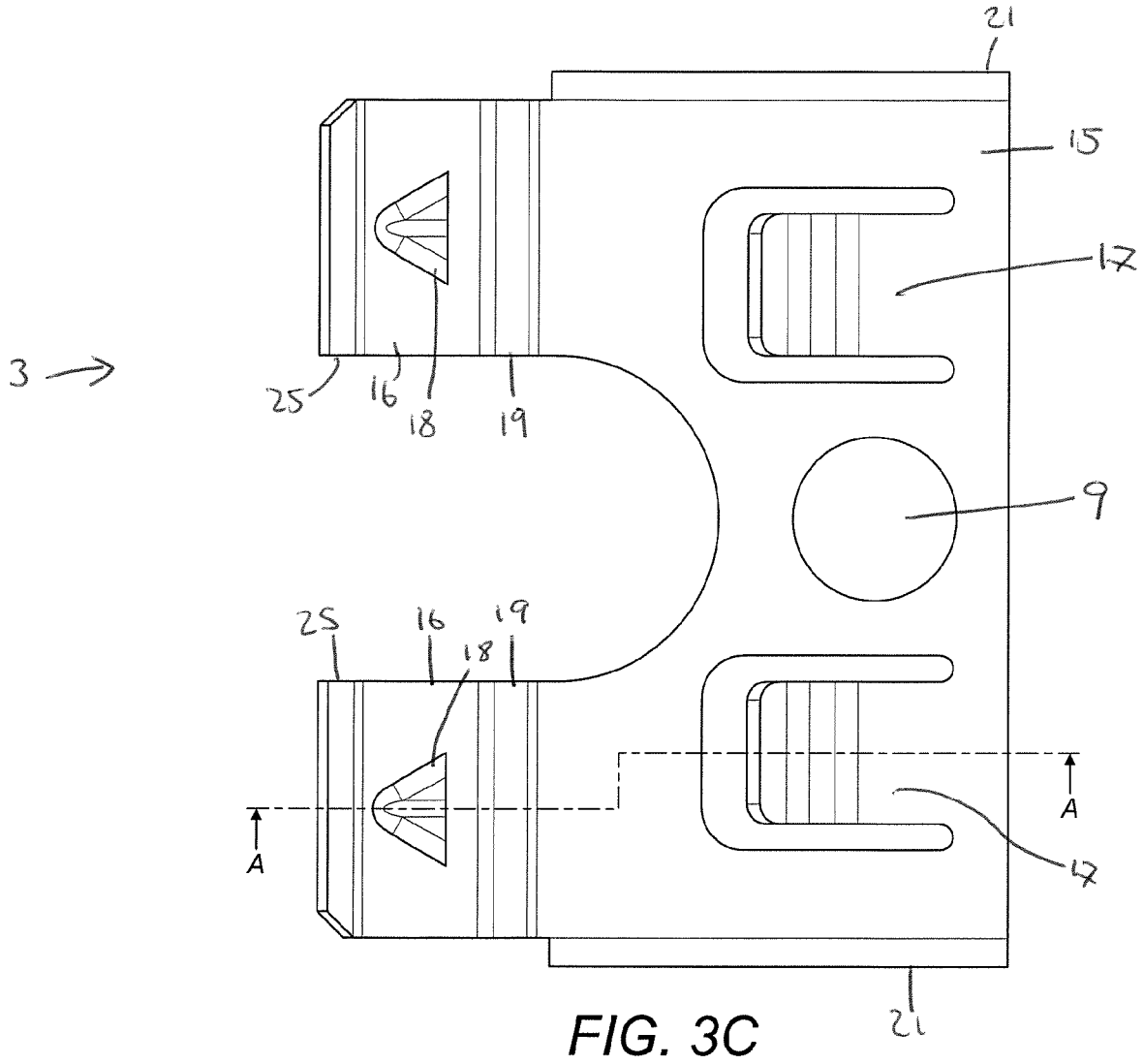
FIG. 3C is a plan view of the same clip.
Figure 3D:
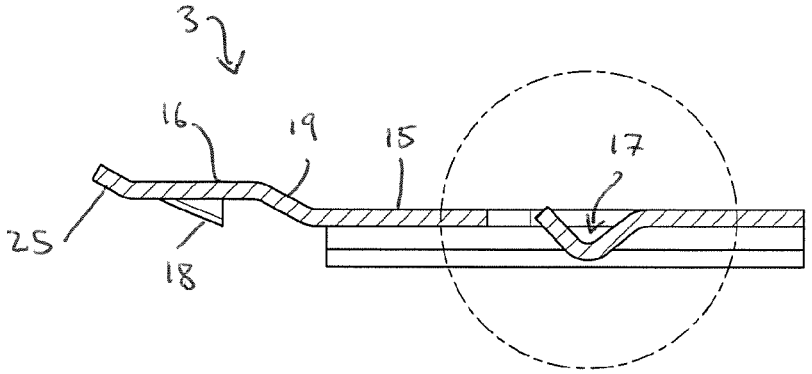
FIG. 3D is a detail view along direction A-A of FIG. 3C.

The same clip 3 can be seen in FIG. 3C. FIG. 3D is a side view of the clip 3 viewed in the direction A-A shown in FIG. 3C. The gripper 18 can be seen protruding down underneath the leg 16 and the fastening element 17 can be seen.

Figure 3E:
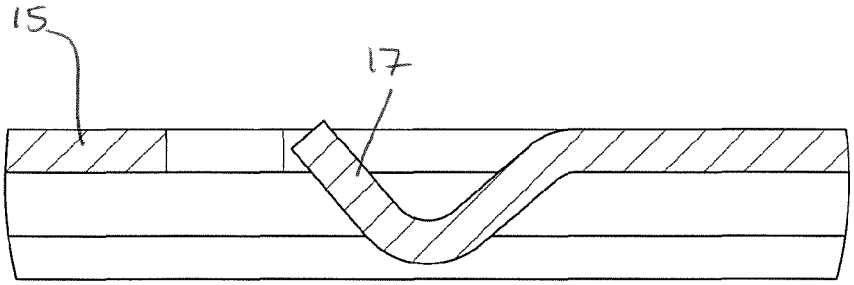
FIG. 3E is a detail view of section B of FIG. 3D.

The fastening element 17 is shown in more detail in FIG. 3E. The angle of the sprung part is shown as 90°, but it may be any other suitable angle that provides a releasable fastening means for securing the clip 3 to a frame element 4.

Figure 3F:
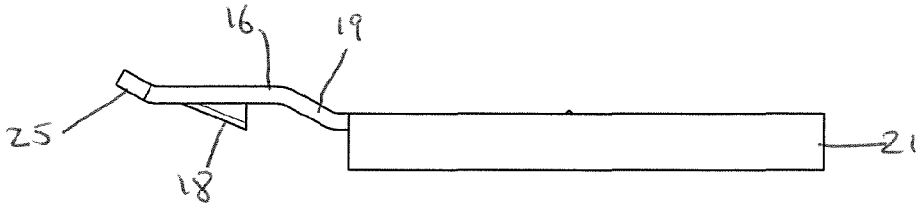
FIG. 3F is a detail side view of a leg of the same clip.

A leg 16 is shown in more detail in FIG. 3F. The angle of the flange 25 is shown as 30° but any suitable angle may be utilised that enables easy installation of a baffle and suspension system to a beam (not shown). In some embodiments, the flange 25 may be omitted to simplify the construction of the clip 3.

The term "upwardly-angled" as used to describe the joint 19 relative to the body plate 15 can be seen clearly in FIGS. 3A, 3D and 3F.

Figure 4A:
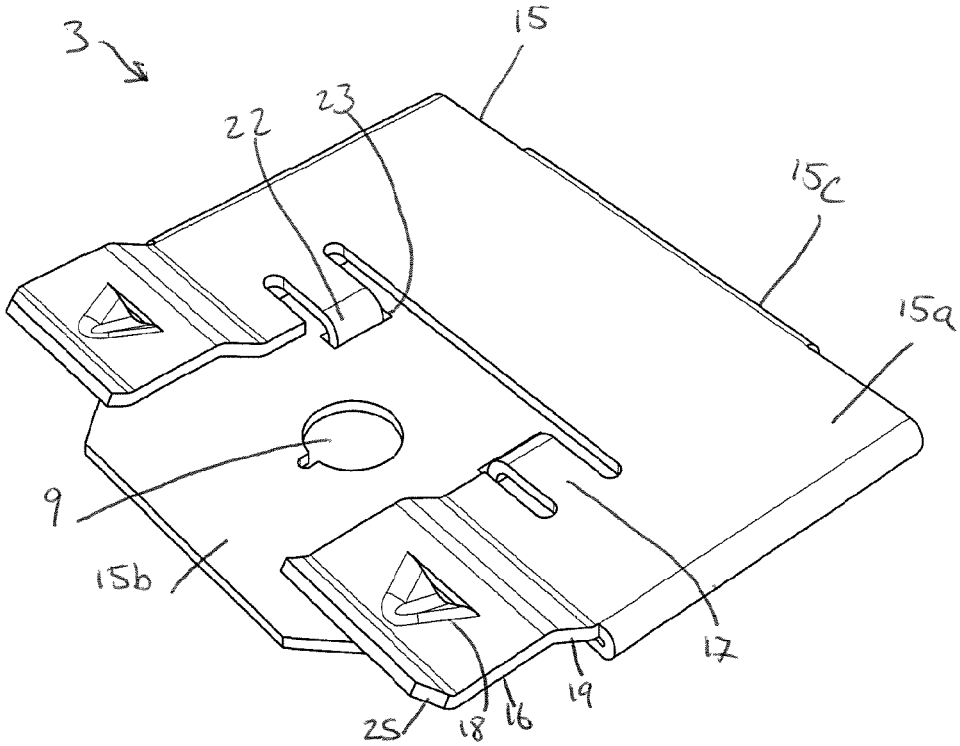
FIG. 4A is a perspective view of another clip according to the invention.
Figure 4B:
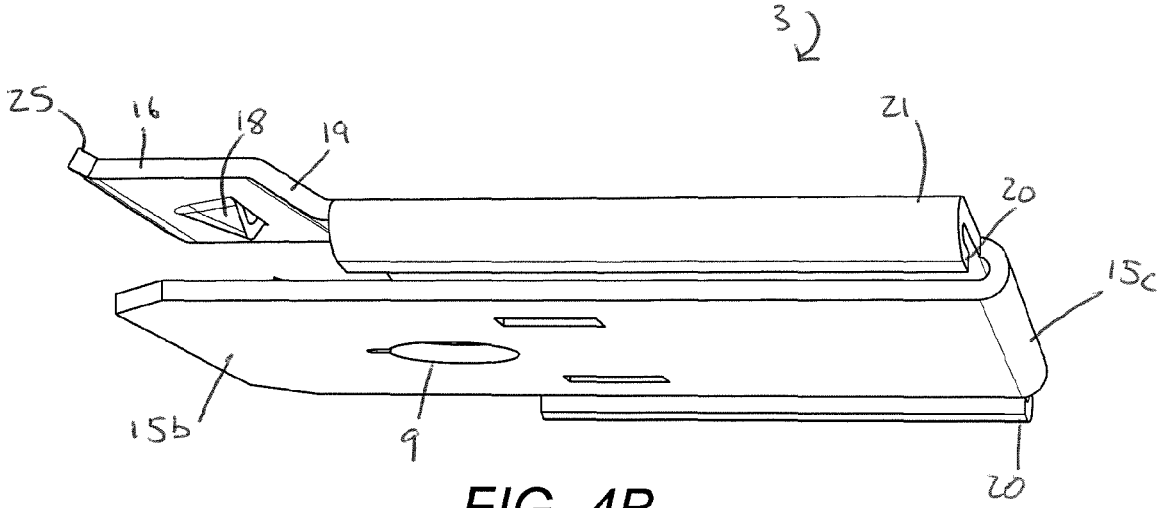
FIG. 4B is an underneath view of the same clip.

An alternative implementation of the clip 3 is shown in FIGS. 4A to 4D. In this type of clip 3, the body plate 15 comprises an upper part 15*a* and a substantially parallel lower part 15*b*, which are connected by a U-shaped fold 15*c*. A first aperture 9 is provided in the lower part 15*b*. In FIG. 4A, the first aperture 9 is of the type known as single thread engaging.

Figure 4C:
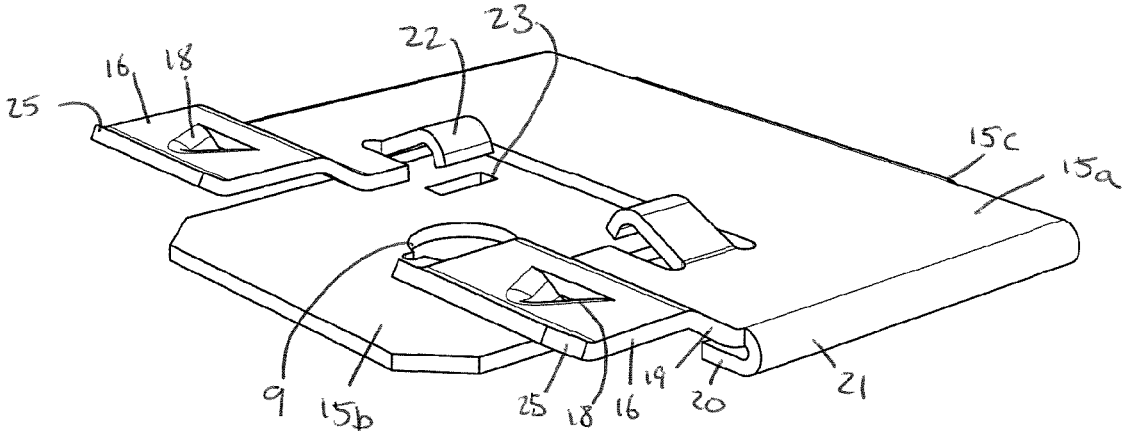
FIG. 4C shows the fastening elements open in the same clip.
Figure 4D:
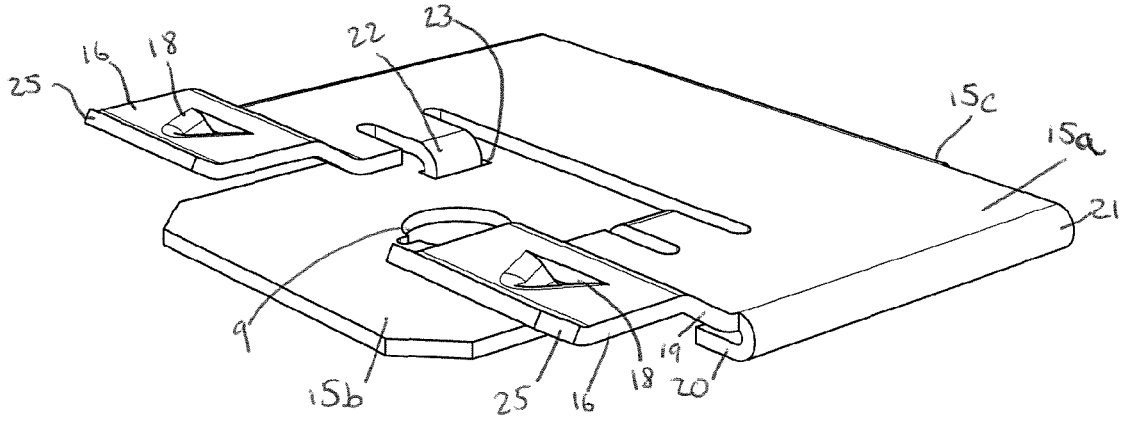
FIG. 4D shows the fastening elements closed in the same clip.

The fastening elements 17 comprise a tongue 22 and slot 23. The tongue is connected to the upper part 15*a* and the slot is formed in the lower part 15*b*. The open position of these fastening elements 17 is shown in FIG. 4C and the closed position in FIG. 4D.

Figure 4E:
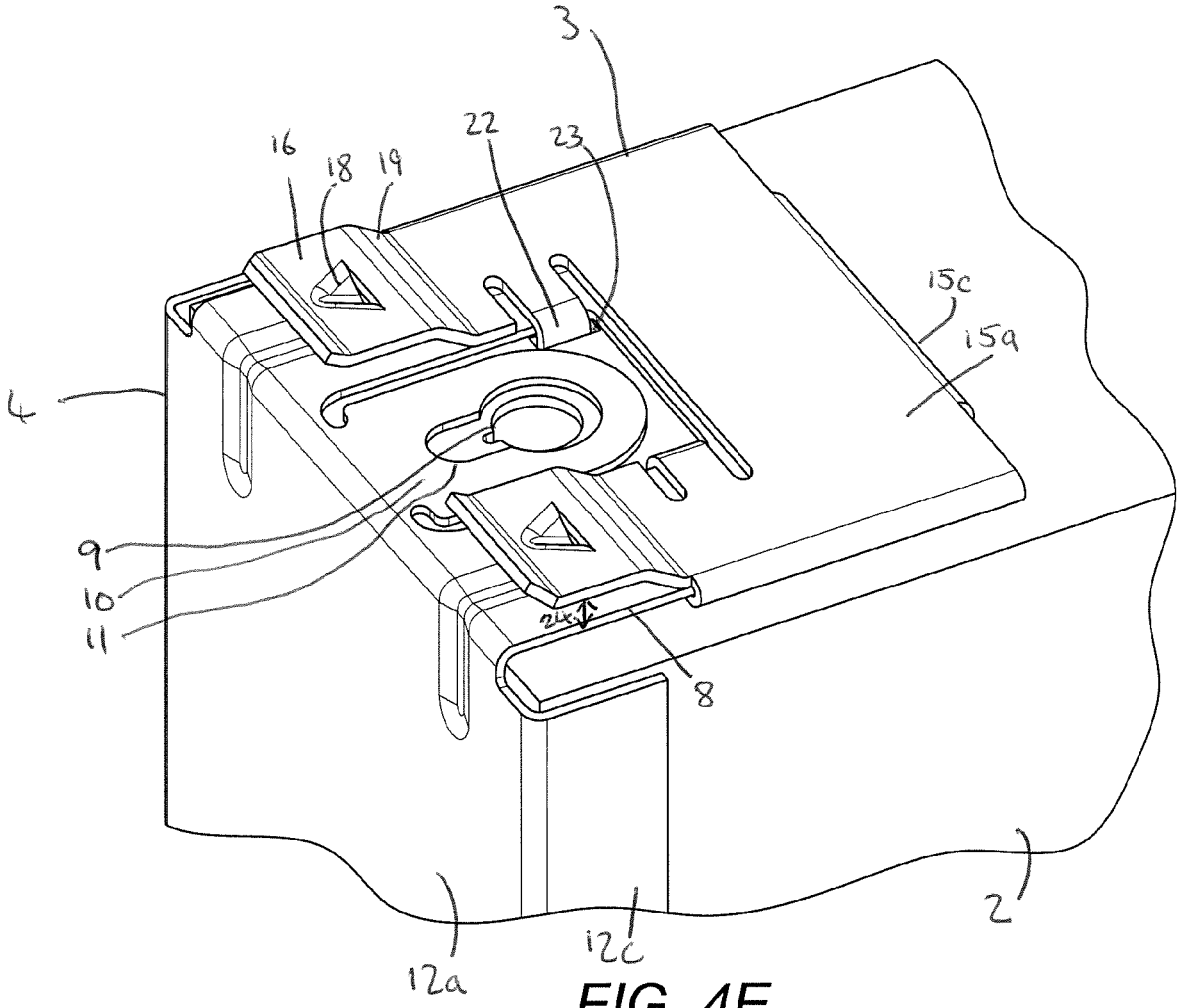
FIG. 4E shows the same clip connected to a frame element in supported of an acoustic baffle.

The interaction of this embodiment of the clip 3 with a frame element 4 is shown in FIG. 4E.

The clip 3 is connected to the frame element by means of the folding of the two parts 15*a* and 15*b* of the plate 15 of the clip 3, that fold around the free end of the flap 8 of the frame element 4 such that the flap 8 lies between the upper part 15*a* and the lower part 15*b* of the body plate 15 of the clip 3.

The flap 8 is shown in an assembled state, folded through approximately 90° to the upper minor face 2*a* of the acoustic baffle 2. The tab 10 is folded down to the upper minor face 2*a* of the acoustic panel 2. In this position, the second aperture 11 (provided in the tab 10) aligns with the threaded first aperture 9 (provided in the lower part 15*b* of the body plate 15 of the clip 3).

The gaps 24 between the legs 16 and the flap 8 form a slot into which the flange of a support beam can fit so as to secure the acoustic baffle 2 in a vertical manner as part of an acoustic ceiling.

The term "upwardly-angled" as used to describe the joint 19 relative to the body plate 15 can be seen clearly in FIGS. 4A-E.

Figure 5A:
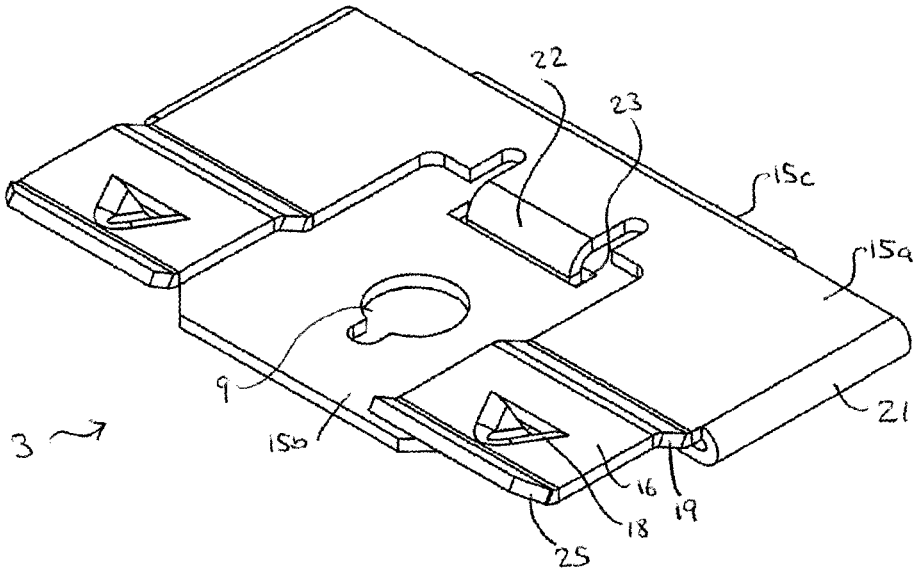
FIG. 5A shows an alternative embodiment of the clip in a closed position.
Figure 5B:
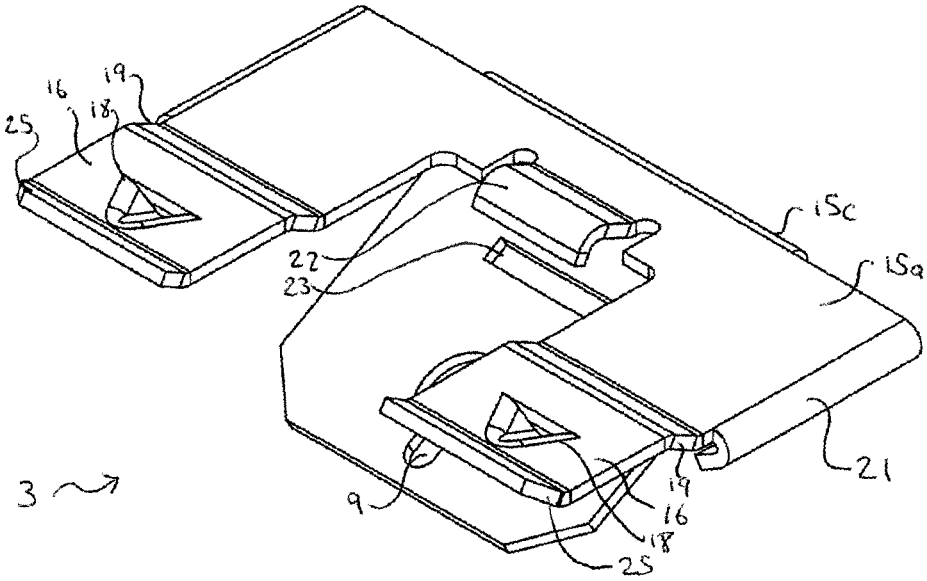
FIG. 5B shows the same clip embodiment in an open position.

FIG. 5A shows a variation on the clip 3. A single fastening element comprising a tongue 22 and slot 23 is provided in the centre of the clip 3. This layout may improve ease of installation. The same clip variation is shown in FIG. 5B in the open state. The upper part 15*a* and lower part 15*b* of the body plate are shown in an open position, with rotation about the joint 15*c*. The clip 3 may be pressed onto the flap of a frame element at the factory or by the installer. The tongue 22 and slot 23 fastening means is secured once the clip 3 is in place around a flap of a frame element.

Figure 6:
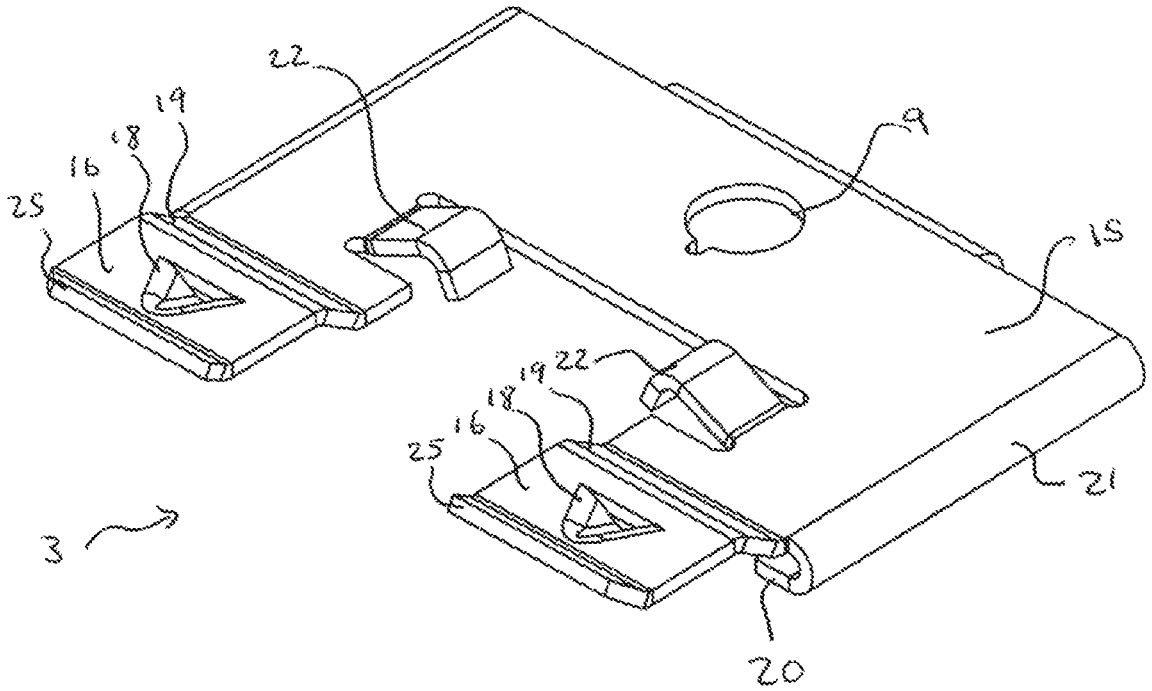
FIG. 6 shows an alternative embodiment of the clip.

FIG. 6 shows a variation of the clip 3, similar to that shown in FIGS. 4A-E. The body plate 15 comprises the first aperture 9 and does not have two sections joined by a fold. The clip 3 comprises two legs 16, joined to the body plate 15 via an upwardly-angled joint 19 and terminating an upwardly-angled flange 25. Each leg is provided with a gripper 18, which facilitates secure connection of a suspension system directly to a beam having an inverted T-profile, because the gripper 18 will bear down on the flange of such a beam.

The term "upwardly-angled" as used to describe the joint 19 relative to the body plate 15 can be seen clearly in FIGS. 5A, 5B and 6.

Figure 7A:
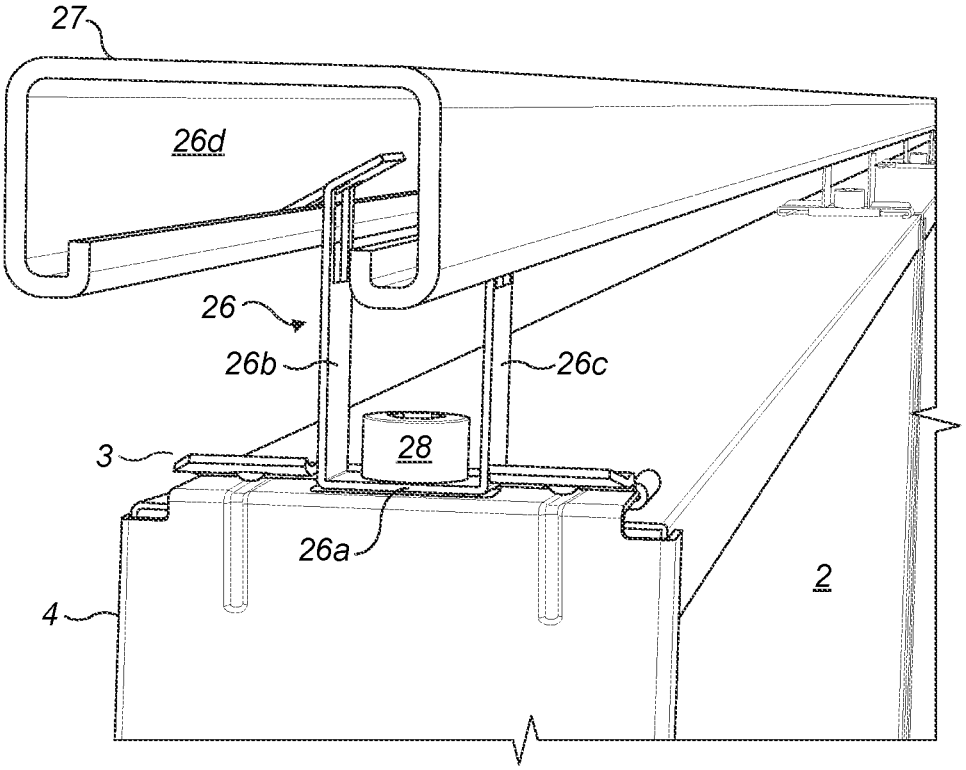
FIG. 7A shows the suspension system in combination with a beam hanger and a C-profile beam.

FIG. 7A demonstrates how an acoustic baffle can be vertically suspended by using the suspension system of the invention in combination with a beam hanger and a C-profile beam. The baffle 2 is supported by the frame element 4 which is connected to the clip 3. A beam hanger 26 is secured to the suspension system by means of a bolt 28 in connection with the first aperture (not shown) of the clip. The beam hanger comprises a substantially rectangular first plate 26*a* connected at opposing edges to a second plate 26*b* and a third plate 26*c* such that the second plate and third plate are substantially parallel and face each other, wherein each of the second and third plates comprises a hinged tab 26*d* that is connectable to a C-profile beam 27.

Adjacent acoustic baffles 2 that are vertically suspended by means of a beam hanger and a C-profile beam are shown in FIGS. 7B and 7C.

Figure 8:
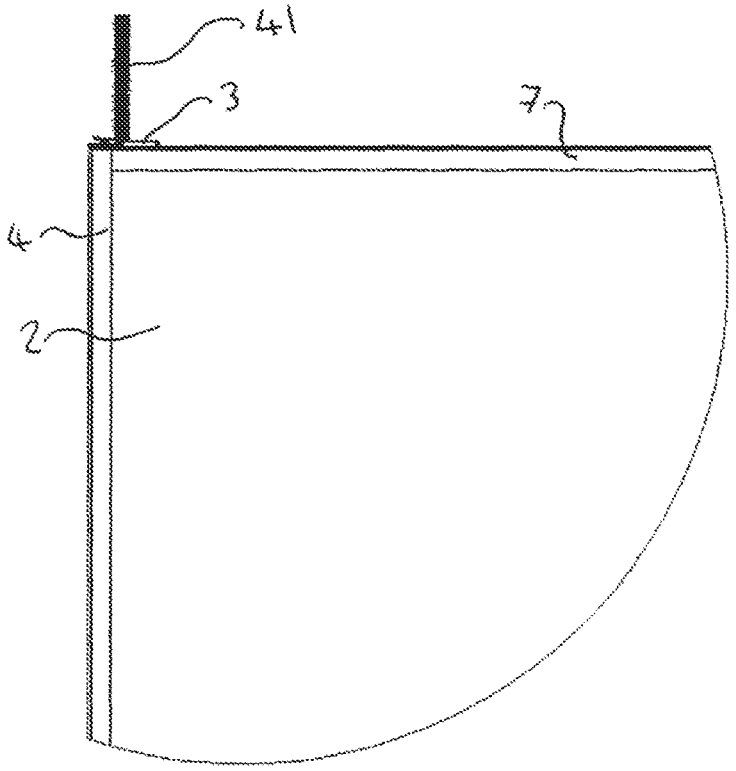
FIG. 8 shows the suspension system with rod suspending means.

Another setup for vertical suspension of an acoustic baffle using the suspension system of the invention is shown in FIG. 8. An acoustic baffle 2 supported by a frame comprising a frame element 4 and an upper profile 7. A clip 3 is secured to the frame element 4. A suspension rod 41 is secured into the first aperture (not shown) of the clip 3, allowing vertical suspension of the acoustic baffle 2 from a soffit either directly or via another device. The suspension rod 41 may be threaded, at least in the lower part, to facilitate engagement with the first aperture (not shown), which may optionally be a single-thread-engaging aperture.

Figure 9A:
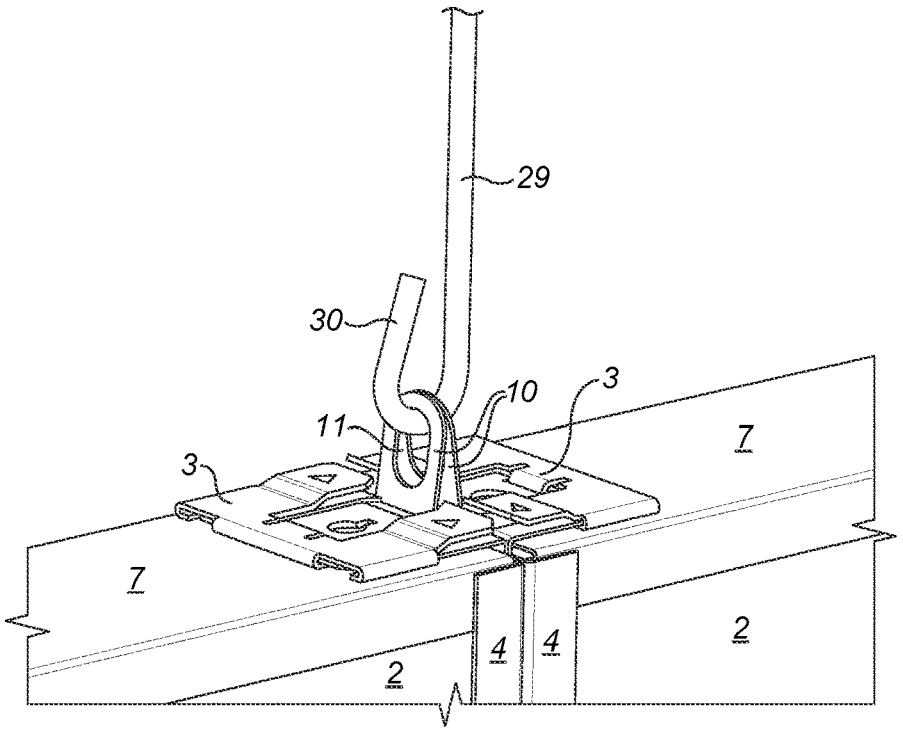
FIGS. 9A-C show the suspension system with hook suspending means.
Figure 9C:
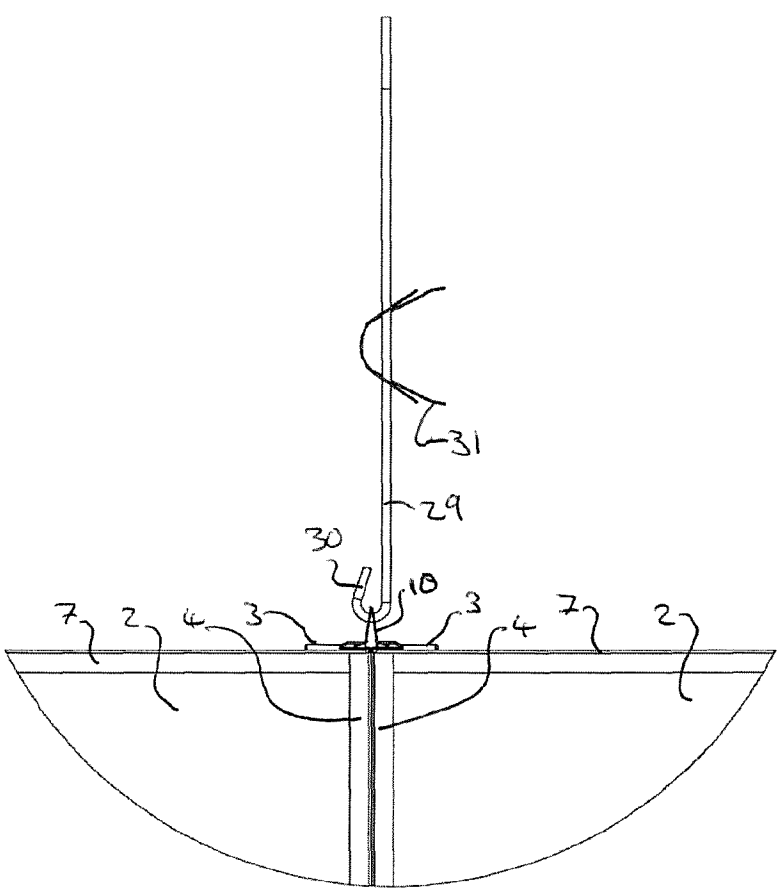
Figure 9B:
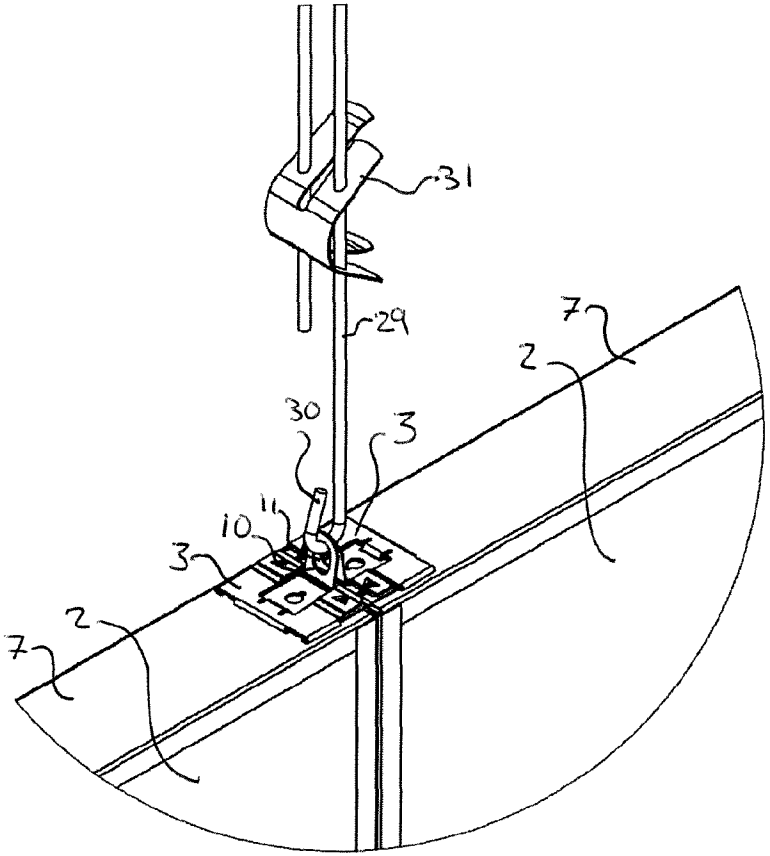

FIGS. 9A, 9B and 9C show how two adjacent acoustic baffles may be suspended using a single hook. In this type of setup, as with any other arrangement where two baffles are suspended so as to be adjacent at a minor face of each baffle, the locking elements 12*d* and 12*e* shown in FIG. 2A may be advantageously used to perfect the alignment of adjacent acoustic baffles. This is, however, optional.

In FIG. 9A, two adjacent acoustic baffles 2 are each supported by a frame comprising an upper profile 7 and a frame element 4. The upper profile 7 is an optional feature. The foldable tab 10 of each frame element 4 is folded to an upright position (it is not essential to be exactly vertical, as can be seen in FIG. 9A). "Upright" as used here refers to the position of the foldable tab 10 relative to the system in the installed state, as illustrated in FIG. 9A. A suspension rod 29 terminating at its lower end in a hook 30 supports both baffles 2 by means of connection between the hood 30 and the second aperture 11 of both foldable tabs 10. This arrangement is efficient on the use of suspension rods, because each rod 29 is shared between adjacent baffles 2.

The same setup is shown in FIGS. 9B and 9C. These figures show connection of the rod 29 to a double spring clip, which enables variation in the suspension height.

Figure 10B:
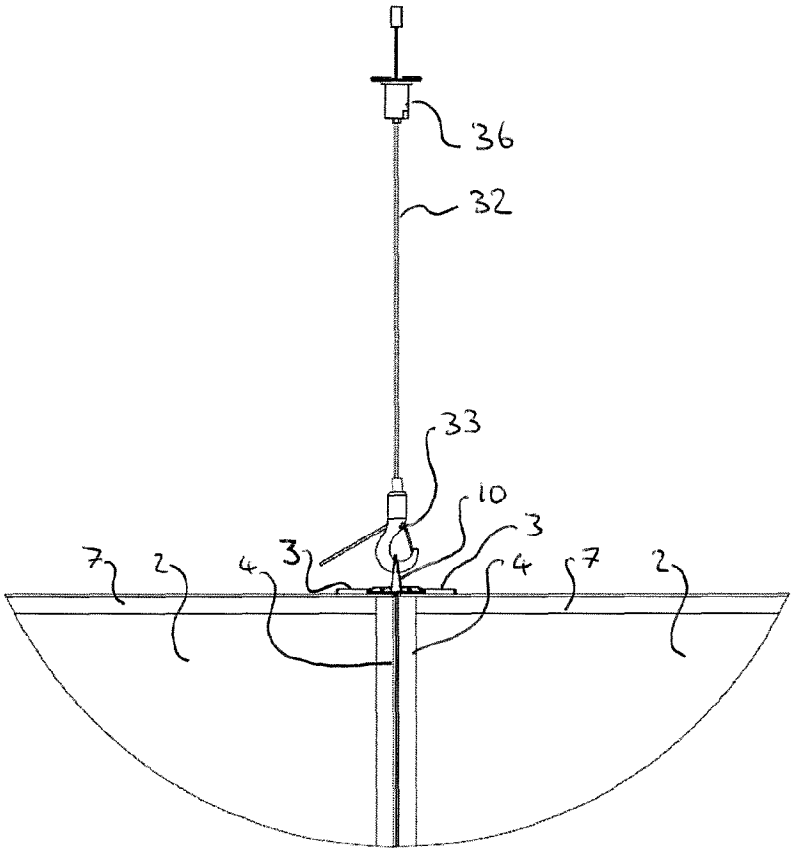
FIGS. 10A-B show the suspension system with karabiner and suspension wire suspending means.
Figure 10A:
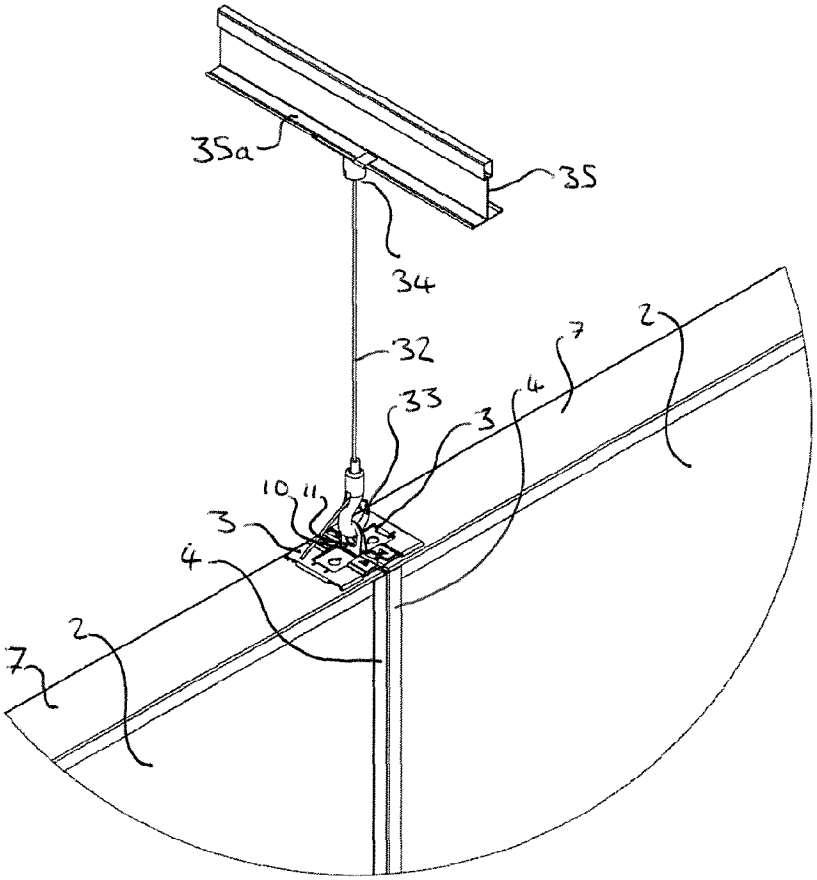

An alternative setup for vertically suspending acoustic baffles is shown in FIG. 10A. Adjacent acoustic baffles 2 are each provided with a clip 3 secured to a frame element 4. Each baffle 2 is provided with an optional upper profile 7 of the frame. The foldable tab 10 of each frame element 4 is provided in an upstanding position, wherein "upstanding" refers to the orientation of the foldable tab relative to the rest of the system in the installed state as shown in FIG. 10A. The second aperture 11 of each foldable tab 10 is used for connection with a karabiner 33.

In FIG. 10A, a single karabiner 33 is connected to two acoustic baffles 2 via the second aperture 11 of each one. However, if the acoustic baffles 2 are to be located in a spaced-apart arrangement, each second aperture 11 may be connected to its own karabiner 33 (the spaced-apart arrangement is not shown).

A suspension wire 32 is provided, which has the karabiner 33 at its lower end and a connection means 34 at its upper end. The connection means 34 is adapted for connection to the flange 35*a* of an inverted T-profile beam 35.

The same karabiner and suspension wire setup may be used for connection directly to a soffit (not shown) rather that to a beam. This is illustrated in FIG. 10B. An alternative connection means 36 is provided at the upper end of the suspension wire 32 to facilitate connection to a soffit.

Figure 11:
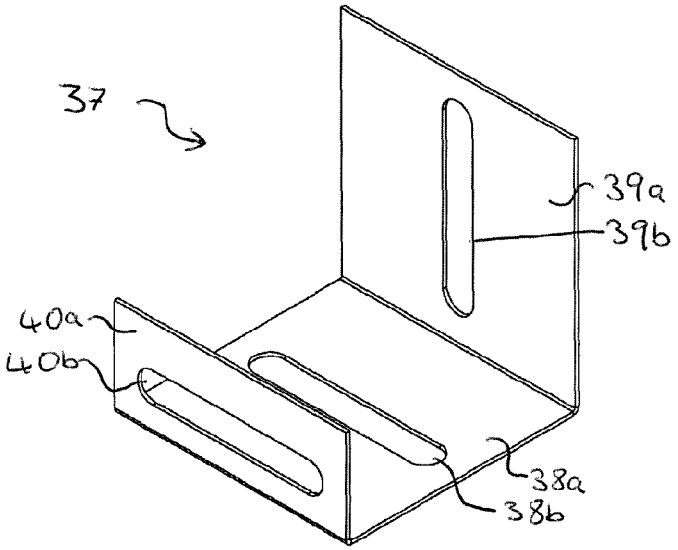
FIG. 11 shows a C-shaped hanger.

In another example of the invention, the suspension means may be in the form of a C-shaped hanger, illustrated in FIG. 11. The hanger 37 comprises a first substantially rectangular plate 38*a* comprising a first elongate aperture 38*b*, a second substantially rectangular plate 39*a* comprising a second elongate aperture 39*b* and being joined at an edge to an edge of the first plate 38*a* in a perpendicular relationship, a third substantially rectangular plate 40*a* comprising a third elongate aperture 40*b* and being joined to at an edge to an edge of the first plate 38*a* opposite to the edge of the first plate 38*a* that is in connection with the second plate 39*a*, such that the third plate 40*a* and the first plate 38*a* are in a perpendicular relationship, the second plate 39*a* and the third plate 40*a* are substantially parallel and face one another. This hanger may be particularly useful for use in environments that normally accelerate corrosion, because this shape of hanger may be easily protected by methods such as galvanisation or powder-coating.

Figure 12A:
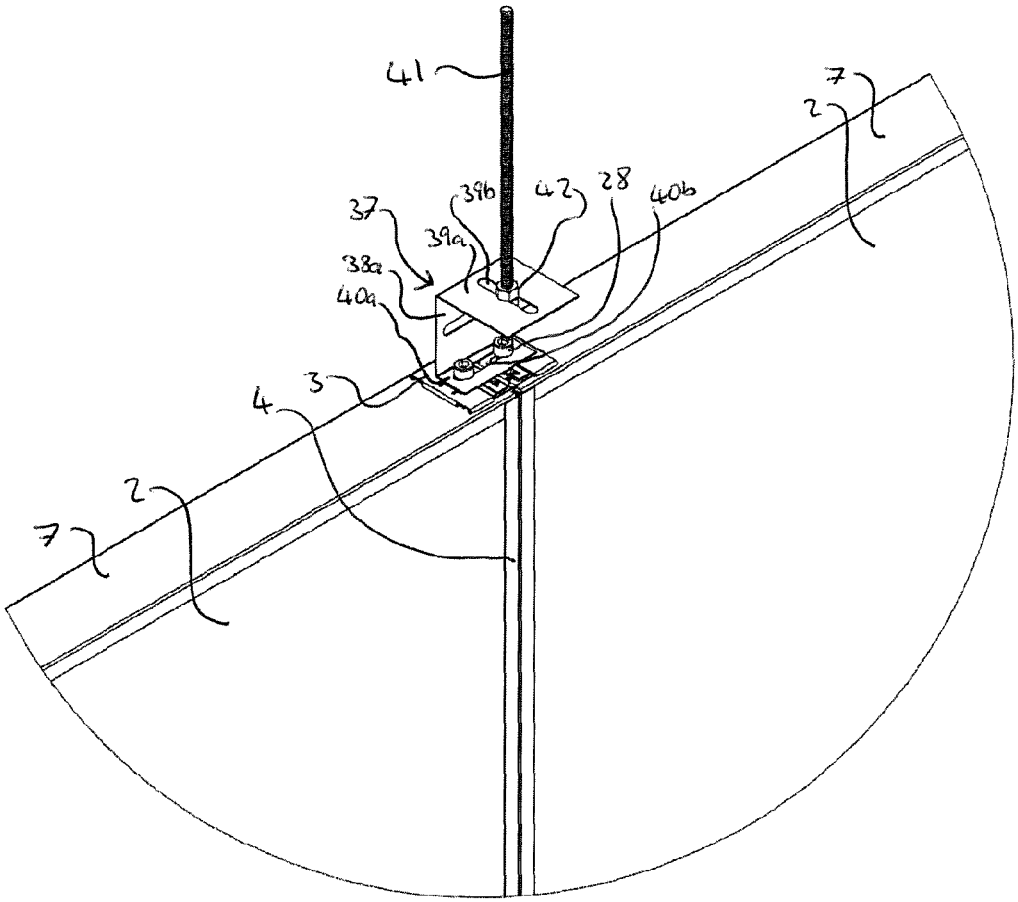
FIGS. 12A-C, 13A-B, 14A-B and 15 show suspension means using the C-shaped hanger.
Figure 12B:
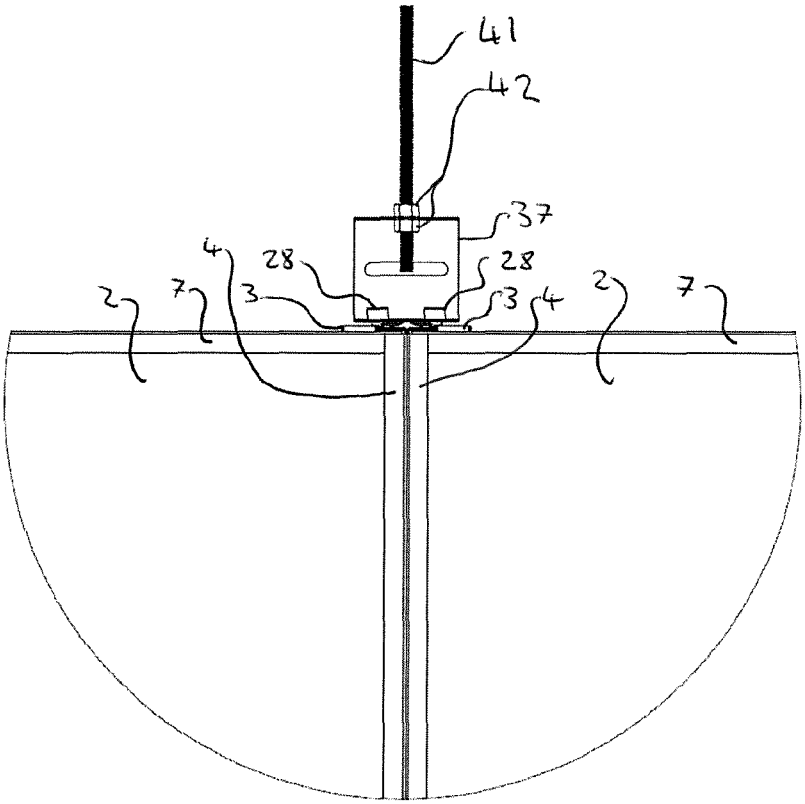
Figure 12C:
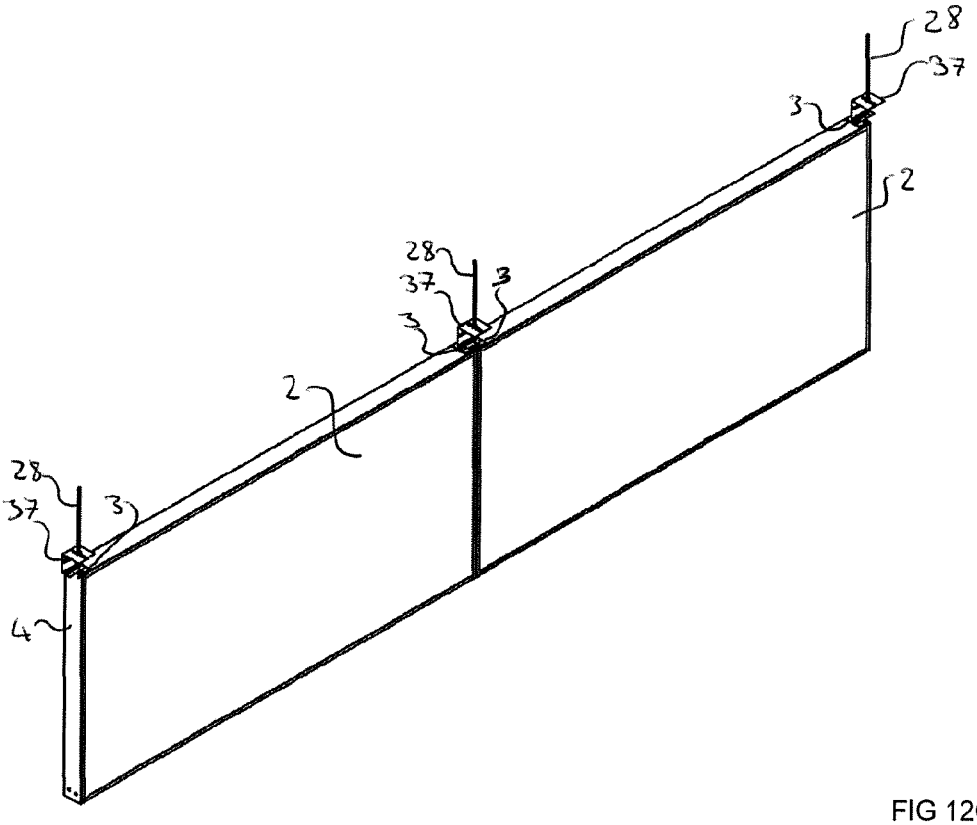
Figure 13A:
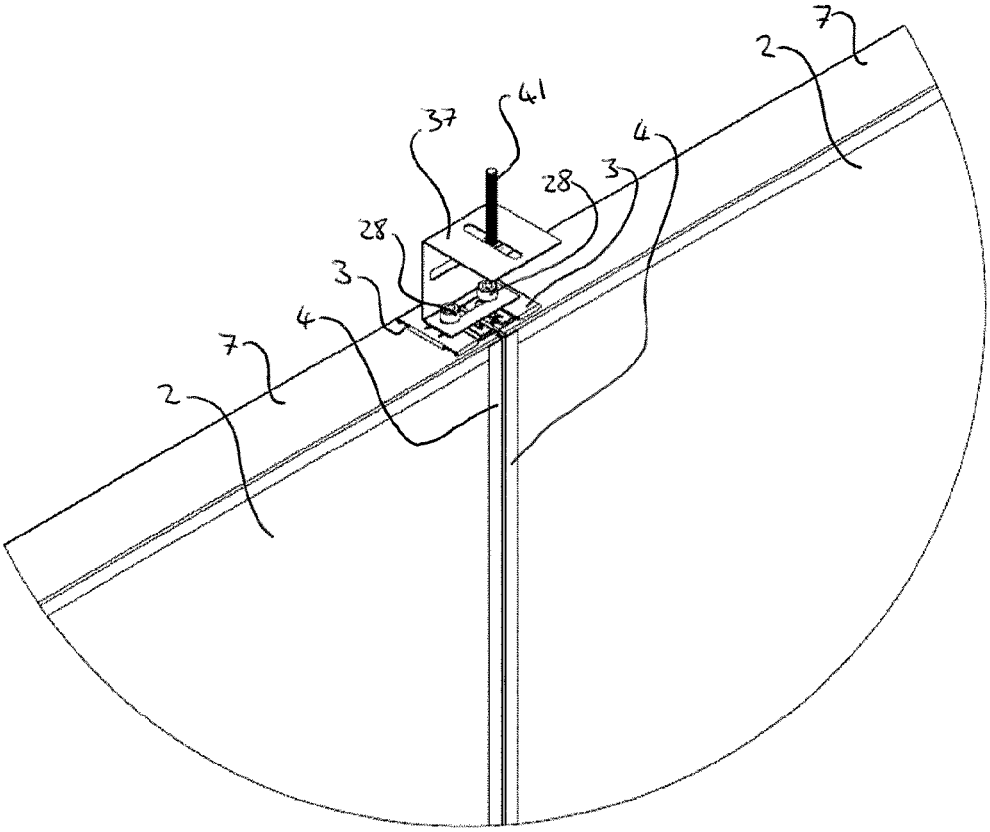
Figure 13B:
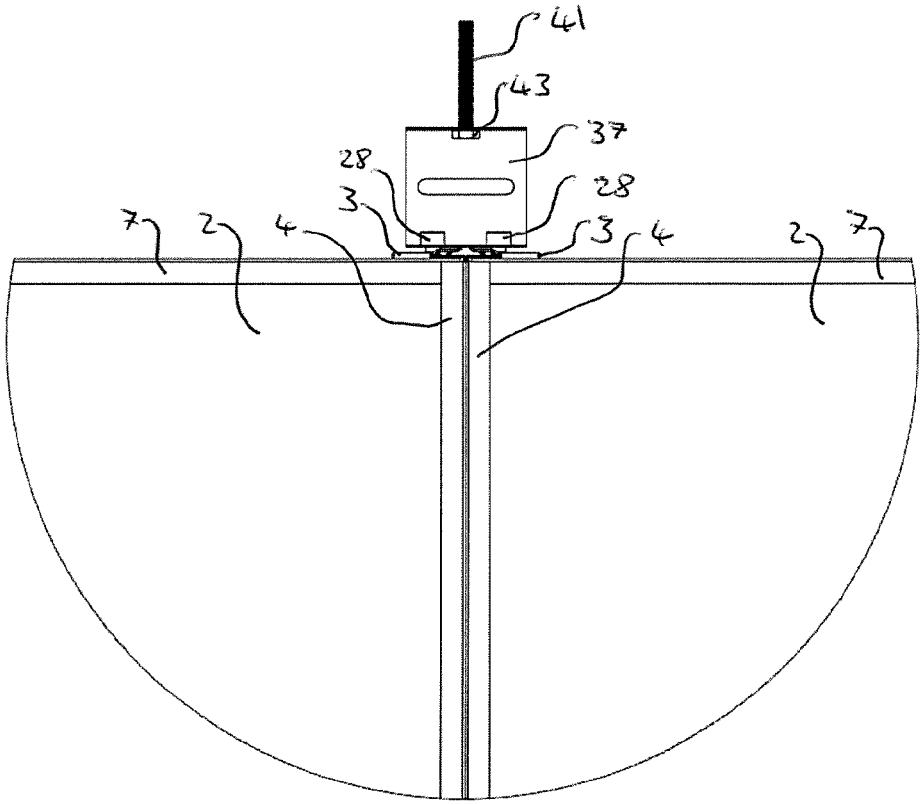

An implementation of the C-shaped hanger 37 is shown in FIGS. 12A and 12B. Two adjacent acoustic baffles 2 are suspended from a single suspension rod 28. The hanger 37 is arranged such that the first plate 38*a* is vertical and the third plate 40*a* is lowermost, such that the third elongate aperture 40*b* extends across the clip 3 of the suspension system supporting each baffle 2. The hanger 37 is secured to each baffle 2 by two bolts 28 that pass through the third elongate aperture 40*b*. Each bolt 28 connects with the first aperture (not shown) of each suspension system. The hanger 37 also connects to a suspension rod 41 through the second elongate aperture 39*b* and is secured by nuts 42, shown in detail in FIGS. 12A and 12B. Alternatively, the rod 41 may be secured to the second plate 39*a* of the hanger 37 by a head 43 at the lower end of the rod 41, as shown in FIGS. 13A and 13B. The full view of two adjacent baffles 2 suspended in this manner is shown in FIG. 12C. This arrangement allows each suspension rod 41 to be shared between adjacent baffles 2, thereby reducing the number of components required to assemble the acoustic ceiling.

Figure 14A:
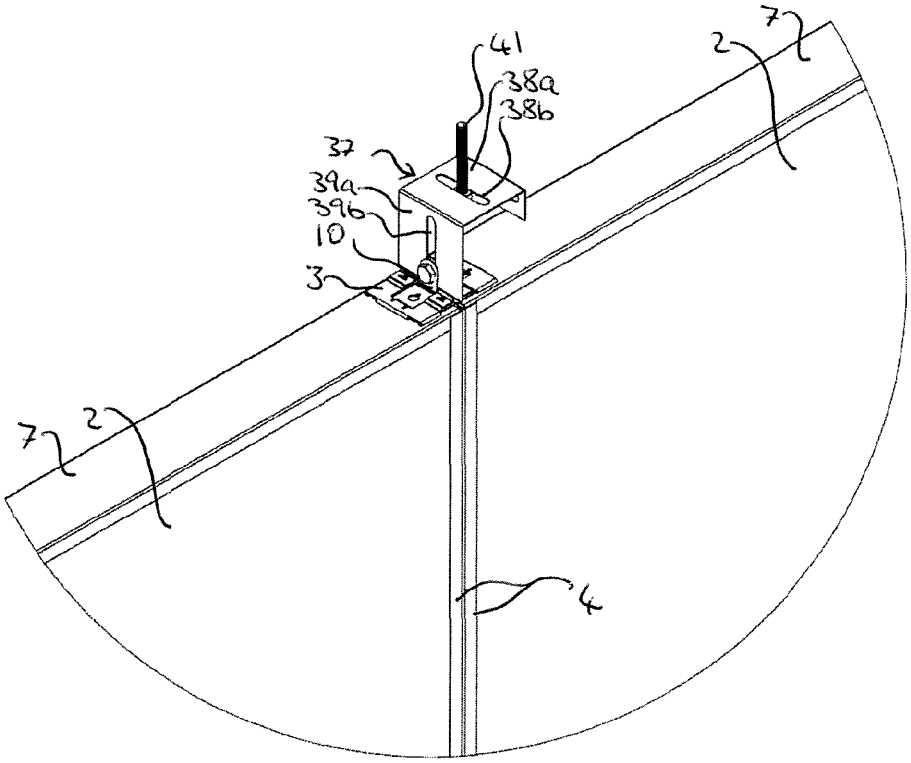
Figure 14B:
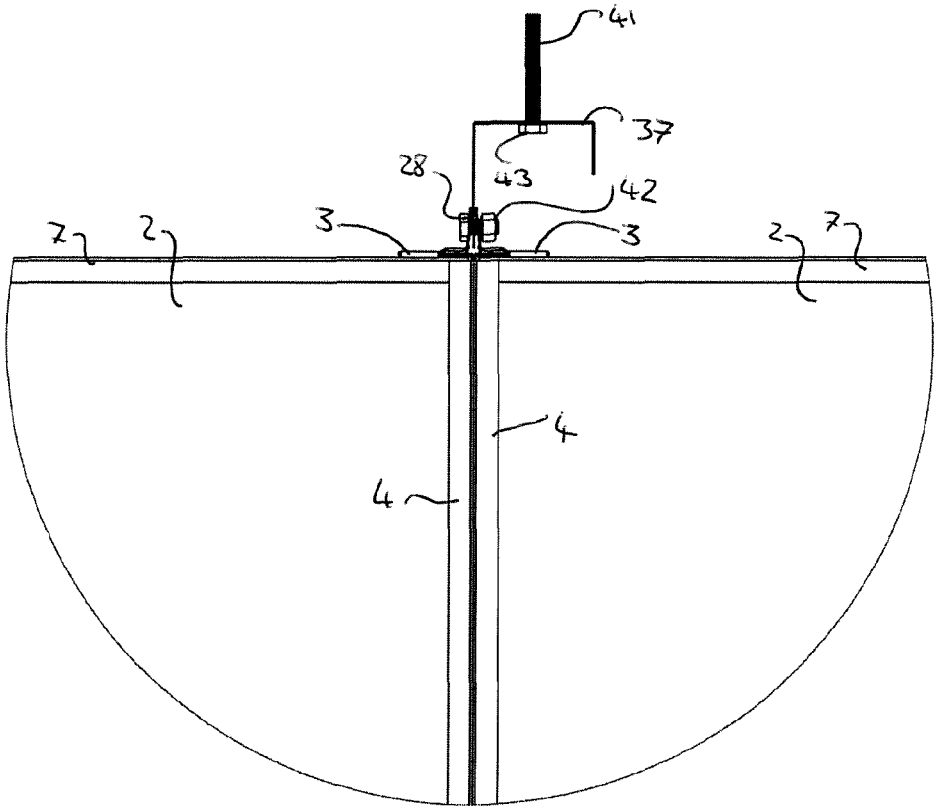

Another implementation of the C-shaped hanger 37 is shown in FIGS. 14A and 14B. Two adjacent acoustic baffles 2 are each supported by a suspension system comprising a frame element 4 that is secured to a clip 3. Optional upper profiles 7 of the frame are provided, but are not essential. The foldable tab 10 of each suspension system is in an upright position. The second plate 39*a* of the hanger 37 is positioned in between the two foldable tabs 10 such that the second apertures 11 of the tabs 10 align with the second elongate aperture 39*b* of the hanger 37. This arrangement is secure with a bolt 28 and nut 42. The first plate 38*a* of the hanger 37 is parallel to the upper profile of the acoustic baffle 2. Vertical suspension is achieved by means of a rod 41 that passes through the first elongate aperture 38*a* of the hanger 37 and is either secured by a nut (not shown) or a head (43) at the lower end of the rod 41.

Figure 15:
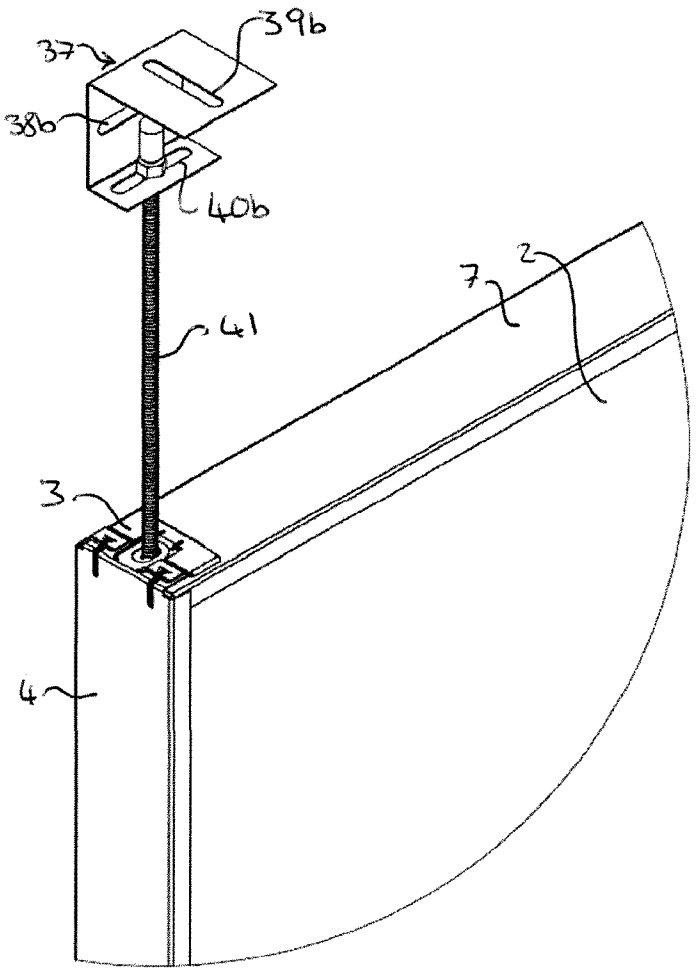

Another implementation of the hanger 37 is shown in FIG. 15. An acoustic baffle 2 supported by a suspension system comprising a frame element 44 secured to a clip 3 is connected to a rod 41 that is secured into the first aperture (not shown) of the suspension system. At its upper end, the rod 41 passes through the third elongate aperture 40*b* of the hanger 37. The first elongate aperture 38*b* and the second elongate aperture 40*b* are free, thereby enabling the hanger 37 to be attached to a wall bracket, a beam, or another fixture on a wall or soffit.

Figure 16A:
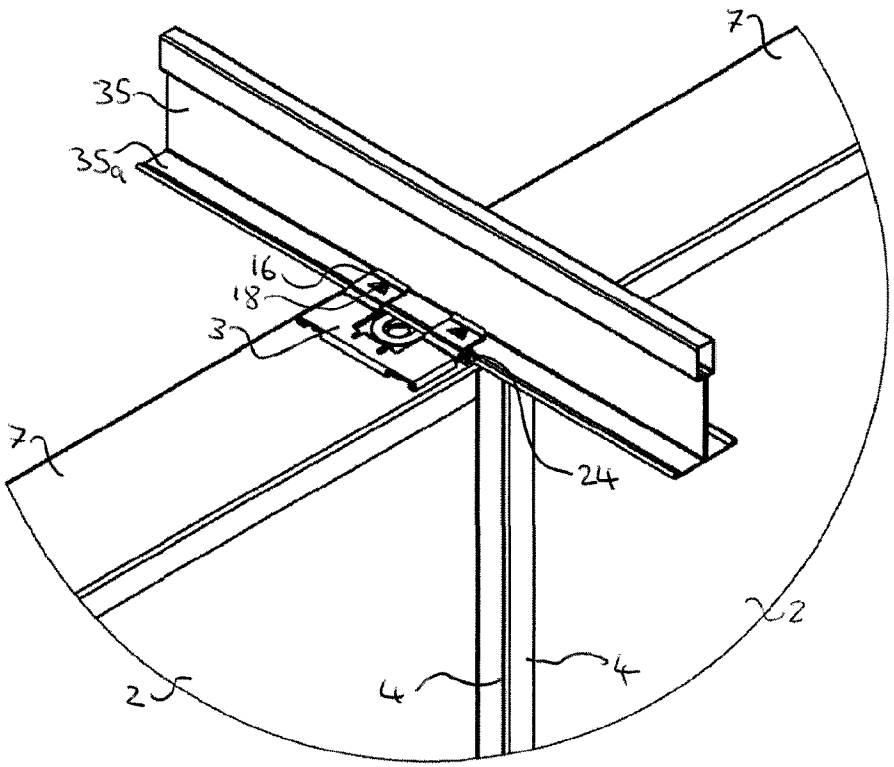
FIGS. 16A-C show direct suspension from a beam.

FIG. 16A shows an arrangement in which the suspension system connects directly to an inverted T-profile beam. An acoustic baffle 2 is provided with an upper frame profile 7 (optional), a side profile 4 and a clip 3. The space 24 that is present between the folded over flap (not visible) of the frame element 4 provides a slot into which the flange 35*a* of the inverted T-profile beam 35 may be inserted. Each leg 16 is provided with a gripper 18 which bears down onto the flange 35*a* to improve the hold of the suspension system on the flange 35*a*.

Figure 16B:
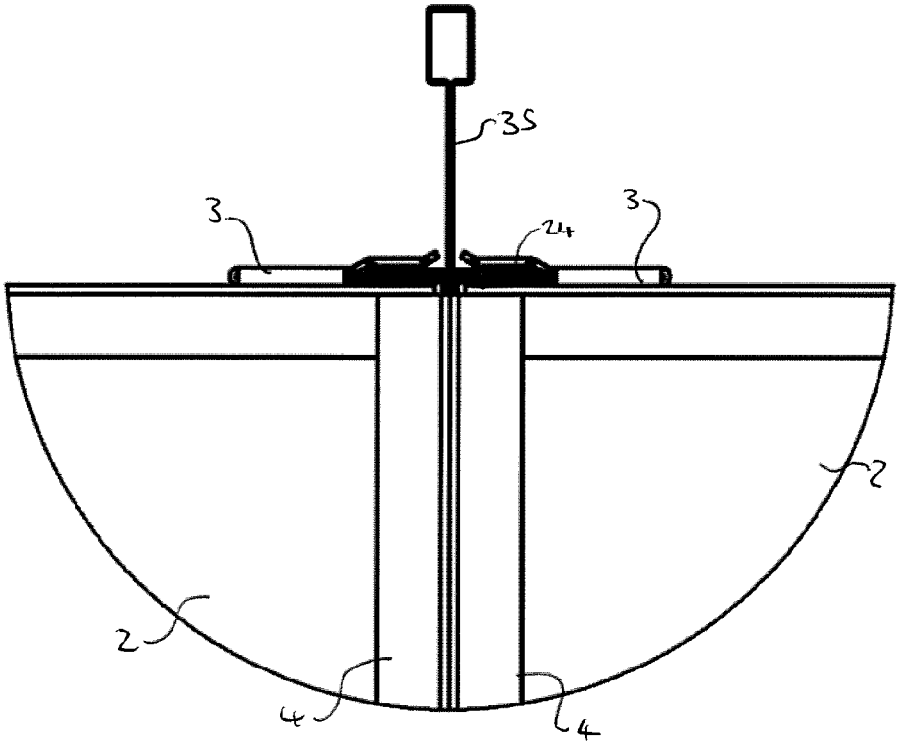
Figure 16C:
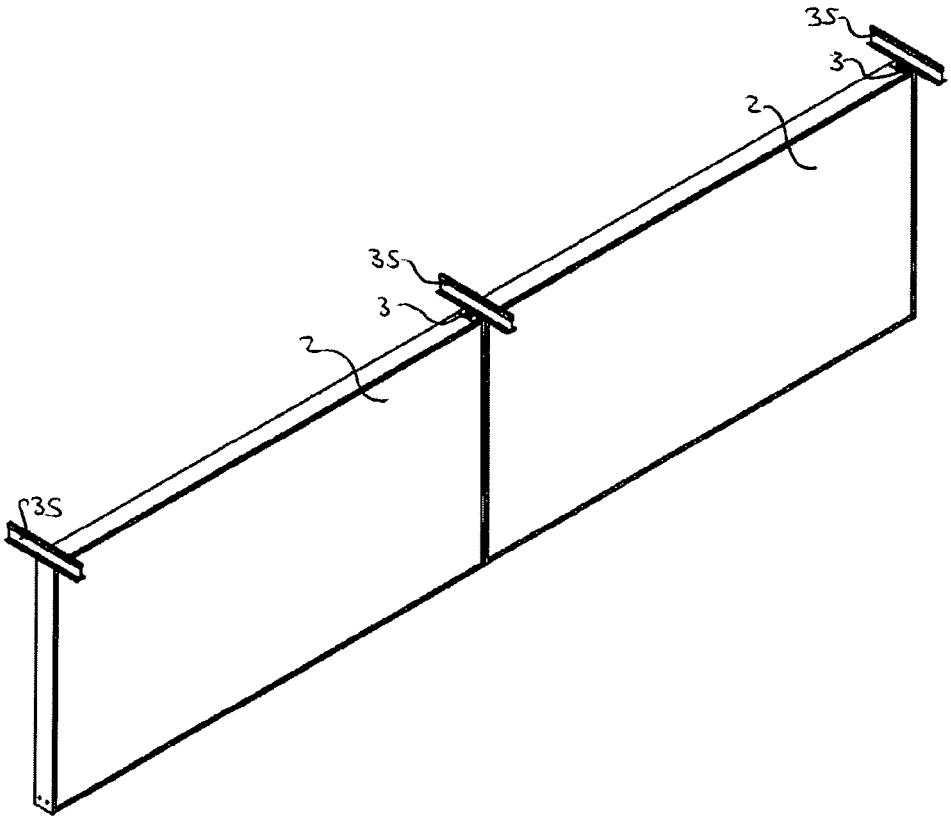

Two acoustic baffles 2 may be connected in this manner adjacently to the same beam, as shown in FIG. 16B. The full layout of two adjacent baffles suspended in this manner is shown in FIG. 16C. It will be apparent that further baffles may be suspended adjacent to these and that along the beams 35 there may be suspended additional baffles or rows of baffles, to provide an array of acoustic baffles for an acoustic ceiling.

The invention claimed is:

1. A clip for use in an acoustic baffle suspension system, the clip comprising a body plate, wherein the clip comprises one or more fastening elements for securing the clip to a frame element, wherein the clip comprises a first aperture, wherein the clip comprises more than one legs joined to the body plate by an upwardly-angled joint such that the more than one legs are parallel to the body plate, wherein the more than one legs each comprise a gripper for secure connection to an inverted T-profile, and wherein the clip is provided with wings on opposing edges of the body plate, wherein each wing is connected to the body plate by a U-shaped fold such that the wing lies underneath and spaced from the body plate so as to be configured to receive the frame element between the wings and the body plate.

2. A system for vertical suspension of an acoustic baffle, the system comprising a) a frame element;

b) a clip according to claim 1 configured for connection to the frame element;

c) a foldable tab comprising a second aperture.

3. The system of claim 2, wherein the more than one legs of the clip are substantially planar legs.

4. The system of claim 3, wherein the first aperture is threaded.

5. The system of claim 2, wherein the first aperture is threaded.

6. The system of claim 2, wherein the foldable tab is a part of the frame element.

7. The system of claim 2, wherein the one or more fastening elements comprise a resilient catch.

8. The system of claim 2, wherein the one or more fastening elements comprise a tongue and slot.

9. The system of claim 2, wherein the body plate of the clip comprises an upper part substantially parallel to a lower part, the upper part and lower part connected by a fold.

10. The system of claim 2, wherein the frame element is a side profile comprising a flap that is foldable around an angle of 90° to an upper minor face of a suspended acoustic baffle.

11. A suspended ceiling comprising the system of claim 2;

an acoustic baffle supported by a frame, the frame comprising two side profiles, wherein at least one of such side profiles comprises the frame element of claim 2.

12. The suspended ceiling of claim 11, further comprising suspension means selected from a grid of beams, suspension wires, suspension rods, and hangers, wherein the suspension means are connectable to the suspension system.

13. The suspended ceiling of claim 12, wherein the suspension means comprises a C-shaped hanger, wherein the hanger comprises;

a first substantially rectangular plate comprising a first elongate aperture, a second substantially rectangular plate comprising a second elongate aperture and being joined at an edge to an edge of the first plate in a perpendicular relationship, a third substantially rectangular plate comprising a third elongate aperture and being joined to at an edge to an edge of the first plate opposite to the edge of the first plate that is in connection with the second plate, such that the third plate and the first plate are in a perpendicular relationship, the second plate and the third plate are substantially parallel and face one another.

14. The suspended ceiling of claim 13, wherein a plate of the C-shaped hanger connects to the first aperture of the suspension system via a rod.

15. The suspended ceiling of claim 13, wherein the second plate of the C-shaped hanger is connectable to a soffit via a rod and wherein the third plate of the C-shaped hanger connects to the first aperture of each of two adjacent suspension systems as defined in claim 2 via bolts.

16. The suspended ceiling of claim 13, wherein two adjacent acoustic baffles are provided, each acoustic baffle being supported by the suspension system, wherein the foldable tab of the clip of each suspension system is provided in an upstanding position, wherein the second elongate aperture of the C-shaped hanger is positioned in between and in alignment with the second aperture of each foldable tab and a bolt passes through all three apertures, wherein the first plate of the C-shaped hanger is connectable to a soffit by means of a bolt.

17. The suspended ceiling of claim 12, wherein the suspension means comprises a beam hanger connected to the first aperture of the clip by a bolt, wherein the beam hanger comprises a substantially rectangular first plate connected at opposing edges to a second plate and a third plate such that the second plate and third plate are substantially parallel and face each other, wherein each of the second and third plates comprises a tab that is connectable to a C-profile beam.

18. The suspended ceiling of claim 12, wherein the foldable tab of the clip is positioned so as to stand upright from the top of the acoustic baffle and wherein the suspension means comprise suspension wires or suspension rods in connection with the second aperture.

19. The suspended ceiling of claim 12, wherein two adjacent acoustic baffles are provided, each acoustic baffle provided with a suspension system as defined in claim 2, wherein the suspension means comprises a suspension wire or rod and wherein a single suspension wire or suspension rod is connected to the second aperture of each of the two adjacent suspension systems.

20. The suspended ceiling of claim 12, wherein the suspension means comprises a grid of beams having an inverted T-profile, wherein the clip of the suspension system comprises one or more substantially planar legs joined to the body plate by an upwardly-angled joint such that the one or more substantially planar legs are parallel to the body plate, such that a flange of the inverted T-profile is connectable to the suspension system in a gap between the legs and the frame element.

* * * * *